US007858163B2

(12) United States Patent
Angadjivand et al.

(10) Patent No.: US 7,858,163 B2
(45) **Date of Patent: *Dec. 28, 2010**

(54) MOLDED MONOCOMPONENT MONOLAYER RESPIRATOR WITH BIMODAL MONOLAYER MONOCOMPONENT MEDIA

(75) Inventors: Seyed A. Angadjivand, Woodbury, MN (US); Andrew R. Fox, Oakdale, MN (US); John D. Stelter, St. Joseph Township, WI (US); Timothy J. Lindquist, Woodbury, MN (US); John M. Brandner, St. Paul, MN (US); James E. Springett, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 498 days.

This patent is subject to a terminal disclaimer.

(21) Appl. No.: 11/461,145

(22) Filed: Jul. 31, 2006

(65) Prior Publication Data

US 2008/0026173 A1 Jan. 31, 2008

(51) Int. Cl.
*A62B 7/00* (2006.01)
*D04H 3/16* (2006.01)

(52) U.S. Cl. ..... 428/36.1; 264/115

(58) Field of Classification Search ..... 428/36.1, 428/221, 373; 128/206.1, 206.12; 442/414; 264/6, 115

See application file for complete search history.

(56) References Cited

U.S. PATENT DOCUMENTS 3,073,735 A * 1/1963 Till et al. ..... 264/113
3,981,650 A 9/1976 Page
4,100,324 A 7/1978 Anderson et al.
4,118,531 A 10/1978 Hauser
4,315,881 A * 2/1982 Nakajima et al. ..... 264/172.14
4,405,297 A 9/1983 Appel et al.
4,536,361 A 8/1985 Torobin
4,536,440 A * 8/1985 Berg ..... 442/346
4,547,420 A 10/1985 Krueger et al.
4,588,537 A 5/1986 Klaase et al.
4,714,647 A 12/1987 Shipp, Jr. et al.
4,807,619 A 2/1989 Dyrud et al.
4,818,464 A 4/1989 Lau
4,883,547 A 11/1989 Japuntich
4,931,355 A 6/1990 Radwanski et al.
4,988,560 A 1/1991 Meyer et al.
5,079,080 A 1/1992 Schwarz
5,227,107 A 7/1993 Dickenson et al.

(Continued)

FOREIGN PATENT DOCUMENTS

EP 0 322 136 B1 2/1994

(Continued)

*Primary Examiner*—Mark Ruthkosky
*Assistant Examiner*—Erik Kashnikow
(74) *Attorney, Agent, or Firm*—Kenneth B. Wood

(57) ABSTRACT

A molded respirator is made from a monocomponent monolayer nonwoven web containing a bimodal mass fraction/fiber size mixture of intermingled continuous monocomponent polymeric microfibers and larger size fibers of the same polymeric composition. The respirator is a cup-shaped porous monocomponent monolayer matrix whose matrix fibers are bonded to one another at at least some points of fiber intersection. The matrix has a King Stiffness greater than 1 N. The respirator may be formed without requiring stiffening layers, bicomponent fibers, or other reinforcement in the filter media layer.

12 Claims, 17 Drawing Sheets

U.S. PATENT DOCUMENTS 5,374,458 A 12/1994 Burgio
5,382,400 A 1/1995 Pike et al.
5,480,466 A * 1/1996 Jackson et al. ..... 55/528
5,496,507 A 3/1996 Angadjivand et al.
5,582,907 A 12/1996 Pall
5,591,335 A * 1/1997 Barboza et al. ..... 210/323.2
5,641,555 A * 6/1997 Berrigan et al. ..... 428/152
5,679,042 A 10/1997 Varona
5,679,379 A 10/1997 Fabbricante et al.
5,681,469 A 10/1997 Barboza et al.
5,685,757 A 11/1997 Kirsch et al.
5,695,376 A 12/1997 Datta et al.
5,707,468 A 1/1998 Arnold et al.
5,721,180 A 2/1998 Pike et al.
5,817,584 A 10/1998 Singer et al.
5,873,968 A 2/1999 Pike et al.
5,877,098 A 3/1999 Tanaka et al.
5,902,540 A 5/1999 Kwok
5,904,298 A 5/1999 Kwok et al.
5,908,598 A 6/1999 Rousseau et al.
5,993,543 A 11/1999 Aoki et al.
5,993,943 A 11/1999 Bodaghi et al.
6,041,782 A 3/2000 Angadjivand et al.
6,176,955 B1 1/2001 Haynes et al.
6,183,670 B1 2/2001 Torobin et al.
6,230,901 B1 5/2001 Ogata et al.
6,269,513 B1 8/2001 Torobin
6,274,238 B1 8/2001 DeLucia
6,315,806 B1 11/2001 Torobin et al.
6,319,865 B1 11/2001 Mikami
6,397,458 B1 6/2002 Jones et al.
6,398,847 B1 6/2002 Jones et al.
6,409,806 B1 6/2002 Jones et al.
6,485,811 B1 11/2002 Horiguchi et al.
6,548,431 B1 4/2003 Bansal et al.
6,562,112 B2 5/2003 Jones et al.
6,607,624 B2 8/2003 Berrigan et al.
6,667,254 B1 12/2003 Thompson et al.
6,723,669 B1 4/2004 Clark et al.
6,743,273 B2 6/2004 Chung et al.
6,800,226 B1 10/2004 Gerking
6,827,764 B2 12/2004 Springett et al.
6,858,297 B1 2/2005 Shah et al.
6,916,752 B2 7/2005 Berrigan et al.
6,923,182 B2 8/2005 Angadjivand et al.
6,998,164 B2 2/2006 Neely et al.
2001/0003082 A1 * 6/2001 kahlbaugh et al. ..... 442/340
2003/0134515 A1 7/2003 David et al.
2003/0162457 A1 8/2003 Berrigan et al.
2004/0097155 A1 5/2004 Olson et al.
2008/0026659 A1 1/2008 Brandner et al.
2008/0026661 A1 1/2008 Fox et al.
2008/0038976 A1 2/2008 Berrigan et al.
2008/0315454 A1 12/2008 Angadjivand et al.
2008/0318014 A1 12/2008 Angadjivand et al.
2008/0318024 A1 12/2008 Angadjivand et al.

FOREIGN PATENT DOCUMENTS

EP 0665315 A1 8/1995
EP 0799342 9/1999
GB 2103491 2/1983
JP 06-207359 7/1994
JP 2001049560 2/2001
JP 2002-180331 6/2002
JP 2002-348737 12/2002
JP 2007054778 3/2007
WO WO 02/46504 6/2002
WO WO 2007/112877 10/2007

* cited by examiner

MOLDED MONOCOMPONENT MONOLAYER RESPIRATOR WITH BIMODAL MONOLAYER MONOCOMPONENT MEDIA

This invention relates to molded (e.g., cup-shaped) personal respirators.

BACKGROUND

Patents relating to molded personal respirators include U.S. Pat. No. 4,536,440 (Berg), U.S. Pat. No. 4,547,420 (Krueger et al.), U.S. Pat. No. 5,374,458 (Burgio) and U.S. Pat. No. 6,827,764 B2 (Springett et al.). Patents relating to breathing mask fabrics include U.S. Pat. No. 5,817,584 (Singer et al.), U.S. Pat. No. 6,723,669 (Clark et al.) and U.S. Pat. No. 6,998,164 B2 (Neely et al.). Other patents or applications relating to nonwoven webs or their manufacture include U.S. Pat. No. 3,981,650 (Page), U.S. Pat. No. 4,100,324 (Anderson), U.S. Pat. No. 4,118,531 (Hauser), U.S. Pat. No. 4,818,464 (Lau), U.S. Pat. No. 4,931,355 (Radwanski et al.), U.S. Pat. No. 4,988,560 (Meyer et al.), U.S. Pat. No. 5,227,107 (Dickenson et al.), U.S. Pat. No. 5,382,400 (Pike et al. '400), U.S. Pat. No. 5,679,042 (Varona), U.S. Pat. No. 5,679,379 (Fabbricante et al.), U.S. Pat. No. 5,695,376 (Datta et al.), U.S. Pat. No. 5,707,468 (Arnold et al.), U.S. Pat. No. 5,721,180 (Pike et al. '180), U.S. Pat. No. 5,877,098 (Tanaka et al.), U.S. Pat. No. 5,902,540 (Kwok), U.S. Pat. No. 5,904,298 (Kwok et al.), U.S. Pat. No. 5,993,543 (Bodaghi et al.), U.S. Pat. No. 6,176,955 B1 (Haynes et al.), U.S. Pat. No. 6,183,670 B1 (Torobin et al.), U.S. Pat. No. 6,230,901 B1 (Ogata et al.), U.S. Pat. No. 6,319,865 B1 (Mikami), U.S. Pat. No. 6,607,624 B2 (Berrigan et al. '624), U.S. Pat. No. 6,667,254 B1 (Thompson et al.), U.S. Pat. No. 6,858,297 B1 (Shah et al.) and U.S. Pat. No. 6,916,752 B2 (Berrigan et al. '752); European Patent No. EP 0 322 136 B1 (Minnesota Mining and Manufacturing Co.); Japanese published application Nos. JP 2001-049560 (Nissan Motor Co. Ltd.), JP 2002-180331 (Chisso Corp. '331) and JP 2002-348737 (Chisso Corp. '737); and U.S. Patent Application Publication No. US2004/0097155 A1 (Olson et al.).

SUMMARY OF THE INVENTION

Existing methods for manufacturing molded respirators generally involve some compromise of web or respirator properties. Setting aside for the moment any inner or outer cover layers used for comfort or aesthetic purposes and not for filtration or stiffening, the remaining layer or layers of the respirator may have a variety of constructions. For example, molded respirators may be formed from bilayer webs made by laminating a meltblown fiber filtration layer to a stiff shell material such as a meltspun layer or staple fiber layer. If used by itself, the filtration layer normally has insufficient rigidity to permit formation of an adequately strong cup-shaped finished molded respirator. The reinforcing shell material also adds undesirable basis weight and bulk, and limits the extent to which unused portions of the web laminate may be recycled. Molded respirators may also be formed from monolayer webs made from bicomponent fibers in which one fiber component can be charged to provide a filtration capability and the other fiber component can be bonded to itself to provide a reinforcing capability. As is the case with a reinforcing shell material, the bonding fiber component adds undesirable basis weight and bulk and limits the extent to which unused portions of the bicomponent fiber web may be recycled. The bonding fiber component also limits the extent to which charge may be placed on the bicomponent fiber web. Molded respirators may also be formed by adding an extraneous bonding material (e.g., an adhesive) to a filtration web, with consequent limitations due to the chemical or physical nature of the added bonding material including added web basis weight and loss of recyclability.

Prior attempts to form molded respirators from monocomponent, monolayer webs have typically been unsuccessful. It has turned out to be quite difficult to obtain an appropriate combination of moldability, adequate stiffness after molding, suitably low pressure drop and sufficient particulate capture efficiency. We have now found monocomponent, monolayer webs which can be so molded to provide useful cup-shaped personal respirators.

The invention provides in one aspect a process for making a molded respirator comprising:

a) forming a monocomponent monolayer nonwoven web containing a bimodal mass fraction/fiber size mixture of intermingled continuous monocomponent polymeric microfibers and larger size fibers of the same polymeric composition, b) charging the web, and c) molding the charged web to form a cup-shaped porous monocomponent monolayer matrix, the matrix fibers being bonded to one another at at least some points of fiber intersection and the matrix having a King Stiffness greater than 1 N.

The invention provides in another aspect a molded respirator comprising a cup-shaped porous monocomponent monolayer matrix containing a charged bimodal mass fraction/fiber size mixture of intermingled continuous monocomponent polymeric microfibers and larger size fibers of the same polymeric composition, the fibers being bonded to one another at at least some points of fiber intersection and the matrix having a King Stiffness greater than 1 N.

The disclosed cup-shaped matrix has a number of beneficial and unique properties. For example, a finished molded respirator may be prepared consisting only of a single layer, but comprising a mixture of microfibers and larger size fibers. Both the microfibers and larger size fibers may be highly charged. The larger size fibers can impart improved moldability and improved stiffness to the molded matrix. The microfibers can impart increased fiber surface area to the web, with beneficial effects such as improved filtration performance. By using microfibers and larger size fibers of different sizes, filtration and molding properties can be tailored to a particular use. And in contrast to the high pressure drop (and thus high breathing resistance) often characteristic of microfiber webs, pressure drops of the disclosed nonwoven webs are kept lower, because the larger fibers physically separate and space apart the microfibers. The microfibers and larger size fibers also appear to cooperate with one another to provide a higher particle depth loading capacity. Product complexity and waste are reduced by eliminating laminating processes and equipment and by reducing the number of intermediate materials. By using direct-web-formation manufacturing equipment, in which a fiber-forming polymeric material is converted into a web in one essentially direct operation, the disclosed webs and matrices can be quite economically prepared. Also, if the matrix fibers all have the same polymeric composition and extraneous bonding materials are not employed, the matrix can be fully recycled.

These and other aspects of the invention will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWING

Like reference symbols in the various figures of the drawing indicate like elements. The elements in the drawing are not to scale.

DETAILED DESCRIPTION

Figure 1:
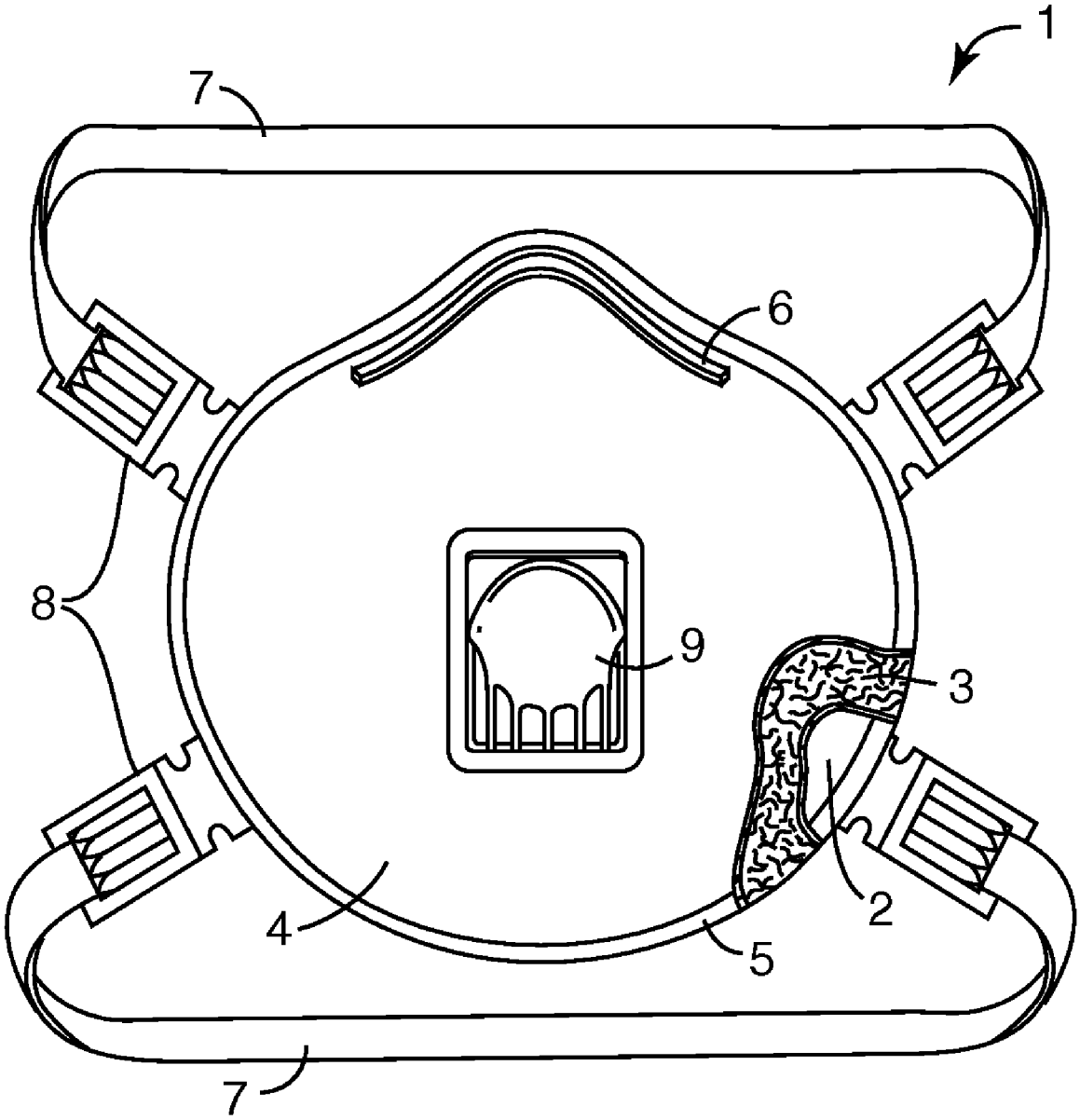
FIG. 1 is a perspective view, partially in section, of a disposable personal respirator having a deformation-resistant cup-shaped porous monolayer matrix disposed between inner and outer cover layers.

The term "molded respirator" means a device that has been molded to a shape that fits over at least the nose and mouth of a person and that removes one or more airborne contaminants when worn by a person.

The term "cup-shaped" when used with respect to a respirator mask body means having a configuration that allows the mask body to be spaced from a wearer's face when worn.

The term "porous" means air-permeable.

The term "monocomponent" when used with respect to a fiber or collection of fibers means fibers having essentially the same composition across their cross-section; monocomponent includes blends (viz., polymer alloys) or additive-containing materials, in which a continuous phase of uniform composition extends across the cross-section and over the length of the fiber.

The term "of the same polymeric composition" means polymers that have essentially the same repeating molecular unit, but which may differ in molecular weight, melt index, method of manufacture, commercial form, etc.

The term "size" when used with respect to a fiber means the fiber diameter for a fiber having a circular cross section, or the length of the longest cross-sectional chord that may be constructed across a fiber having a non-circular cross-section.

The term "continuous" when used with respect to a fiber or collection of fibers means fibers having an essentially infinite aspect ratio (viz., a ratio of length to size of e.g., at least about 10,000 or more).

The term "Effective Fiber Diameter" when used with respect to a collection of fibers means the value determined according to the method set forth in Davies, C. N., "The Separation of Airborne Dust and Particles", Institution of Mechanical Engineers, London, Proceedings 1B, 1952 for a web of fibers of any cross-sectional shape be it circular or non-circular.

The term "mode" when used with respect to a histogram of mass fraction vs. fiber size in μm or a histogram of fiber count (frequency) vs. fiber size in μm means a local peak whose height is larger than that for fiber sizes 1 and 2 μm smaller and 1 and 2 μm larger than the local peak.

The term "bimodal mass fraction/fiber size mixture" means a collection of fibers having a histogram of mass fraction vs. fiber size in μm exhibiting at least two modes. A bimodal mass fraction/fiber size mixture may include more than two modes, for example it may be a trimodal or higher-modal mass fraction/fiber size mixture.

The term "bimodal fiber count/fiber size mixture" means a collection of fibers having a histogram of fiber count (frequency) vs. fiber size in μm exhibiting at least two modes whose corresponding fiber sizes differ by at least 50% of the smaller fiber size. A bimodal fiber count/fiber size mixture may include more than two modes, for example it may be a trimodal or higher-modal fiber count/fiber size mixture.

The term "bonding" when used with respect to a fiber or collection of fibers means adhering together firmly; bonded fibers generally do not separate when a web is subjected to normal handling.

The term "nonwoven web" means a fibrous web characterized by entanglement or point bonding of the fibers.

The term "monolayer matrix" when used with respect to a nonwoven web containing a bimodal mass fraction/fiber size mixture of fibers means having (other than with respect to fiber size) a generally uniform distribution of similar fibers throughout a cross-section of the web, and having (with respect to fiber size) fibers representing each modal population present throughout a cross-section of the web. Such a monolayer matrix may have a generally uniform distribution of fiber sizes throughout a cross-section of the web or may, for example, have a depth gradient of fiber sizes such as a preponderance of larger size fibers proximate one major face of the web and a preponderance of smaller size fibers proximate the other major face of the web.

The term "attenuating the filaments into fibers" means the conversion of a segment of a filament into a segment of greater length and smaller size.

The term "meltspun" when used with respect to a nonwoven web means a web formed by extruding a low viscosity melt through a plurality of orifices to form filaments, quenching the filaments with air or other fluid to solidify at least the surfaces of the filaments, contacting the at least partially solidified filaments with air or other fluid to attenuate the filaments into fibers and collecting a layer of the attenuated fibers.

The term "meltspun fibers" means fibers issuing from a die and traveling through a processing station in which the fibers are permanently drawn and polymer molecules within the fibers are permanently oriented into alignment with the longitudinal axis of the fibers. Such fibers are essentially continuous and are entangled sufficiently that it is usually not possible to remove one complete meltspun fiber from a mass of such fibers.

The term "oriented" when used with respect to a polymeric fiber or collection of such fibers means that at least portions of the polymeric molecules of the fibers are aligned lengthwise of the fibers as a result of passage of the fibers through equipment such as an attenuation chamber or mechanical drawing machine. The presence of orientation in fibers can be detected by various means including birefringence measurements and wide-angle x-ray diffraction.

The term "Nominal Melting Point" means the peak maximum of a second-heat, total-heat-flow differential scanning calorimetry (DSC) plot in the melting region of a polymer if there is only one maximum in that region; and, if there is more than one maximum indicating more than one melting point (e.g., because of the presence of two distinct crystalline phases), as the temperature at which the highest-amplitude melting peak occurs.

The term "meltblown" when used with respect to a nonwoven web means a web formed by extruding a fiber-forming material through a plurality of orifices to form filaments while contacting the filaments with air or other attenuating fluid to attenuate the filaments into fibers and thereafter collecting a layer of the attenuated fibers.

The term "meltblown fibers" means fibers prepared by extruding molten fiber-forming material through orifices in a die into a high-velocity gaseous stream, where the extruded material is first attenuated and then solidifies as a mass of fibers. Although meltblown fibers have sometimes been reported to be discontinuous, the fibers generally are long and entangled sufficiently that it is usually not possible to remove one complete meltblown fiber from a mass of such fibers or to trace one meltblown fiber from beginning to end.

The term "microfibers" means fibers having a median size (as determined using microscopy) of 10 μm or less; "ultrafine microfibers" means microfibers having a median size of two μm or less; and "submicron microfibers" means microfibers having a median size one μm or less. When reference is made herein to a batch, group, array, etc. of a particular kind of microfiber, e.g., "an array of submicron microfibers," it means the complete population of microfibers in that array, or the complete population of a single batch of microfibers, and not only that portion of the array or batch that is of submicron dimensions.

The term "separately prepared smaller size fibers" means a stream of smaller size fibers produced from a fiber-forming apparatus (e.g., a die) positioned such that the stream is initially spatially separate (e.g., over a distance of about 1 inch (25 mm) or more from, but will merge in flight and disperse into, a stream of larger size fibers.

The term "charged" when used with respect to a collection of fibers means fibers that exhibit at least a 50% loss in Quality Factor QF (discussed below) after being exposed to a 20 Gray absorbed dose of 1 mm beryllium-filtered 80 KVp X-rays when evaluated for percent dioctyl phthalate (% DOP) penetration at a face velocity of 7 cm/sec.

The term "self-supporting" when used with respect to a monolayer matrix means that the matrix does not include a contiguous reinforcing layer of wire, plastic mesh, or other stiffening material even if a molded respirator containing such matrix may include an inner or outer cover web to provide an appropriately smooth exposed surface or may include weld lines, folds or other lines of demarcation to strengthen selected portions of the respirator.

The term "King Stiffness" means the force required using a King Stiffness Tester from J. A. King & Co., Greensboro, N.C. to push a flat-faced, 2.54 cm diameter by 8.1 m long probe against a molded cup-shaped respirator prepared by forming a test cup-shaped matrix between mating male and female halves of a hemispherical mold having a 55 mm radius and a 310 $cm^3$ volume. The molded matrices are placed under the tester probe for evaluation after first being allowed to cool.

Referring to FIG. 1, a cup-shaped disposable personal respirator 1 is shown in partial cross-section. Respirator 1 includes inner cover web 2, monocomponent filtration layer 3, and outer cover layer 4. Welded edge 5 holds these layers together and provides a face seal region to reduce leakage past the edge of respirator 1. Leakage may be further reduced by pliable dead-soft nose band 6 of for example a metal such as aluminum or a plastic such as polypropylene Respirator 1 also includes adjustable head and neck straps 7 fastened using tabs 8, and exhalation valve 9. Aside from the monocomponent filtration layer 2, further details regarding the construction of respirator 1 will be familiar to those skilled in the art.

The disclosed monocomponent monolayer web contains a bimodal mass fraction/fiber size mixture of microfibers and larger size fibers. The microfibers may for example have a size range of about 0.1 to about 10 μm, about 0.1 to about 5 μm or about 0.1 to about 1 μm. The larger size fibers may for example have a size range of about 10 to about 70 μm, about 10 to about 50 μm or about 15 to about 50 μm. A histogram of mass fraction vs. fiber size in μm may for example have a microfiber mode of about 0.1 to about 10 μm, about 0.5 to about 8 μm or about 1 to about 5 μm, and a larger size fiber mode of more than 10 μm, about 10 to about 50 μm, about 10 to about 40 μm or about 12 to about 30 μm. The disclosed web may also have a bimodal fiber count/fiber size mixture whose histogram of fiber count (frequency) vs. fiber size in μm exhibits at least two modes whose corresponding fiber sizes differ by at least 50%, at least 100%, or at least 200% of the smaller fiber size. The microfibers may also for example provide at least 20% of the fibrous surface area of the web, at least 40% or at least 60%. The web may have a variety of Effective Fiber Diameter (EFD) values, for example an EFD of about 5 to about 40 μm, or of about 6 to about 35 μm. The web may also have a variety of basis weights, for example a basis weight of about 60 to about 300 grams/$m^2$ or about 80 to about 250 grams/$m^2$. When flat (viz., unmolded), the web may have a variety of Gurley Stiffness values, for example a Gurley Stiffness of at least about 500 mg, at least about 1000 mg or at least about 2000 mg. When evaluated at a 13.8 cm/sec face velocity and using an NaCl challenge, the flat web preferably has an initial filtration quality factor QF of at least about 0.4 $mm^{-1}$ $H_2O$ and more preferably at least about 0.5 $mm^{-1}$ $H_2O$.

The molded matrix has a King Stiffness greater than 1 N and more preferably at least about 2 N or more. As a rough approximation, if a hemispherical molded matrix sample is allowed to cool, placed cup-side down on a rigid surface, depressed vertically (viz., dented) using an index finger and then the pressure released, a matrix with insufficient King Stiffness may tend to remain dented and a matrix with adequate King Stiffness may tend to spring back to its original hemispherical configuration. Some of the molded matrices shown below in the working examples were also or instead evaluated by measuring Deformation Resistance (DR), using a Model TA-XT2i/5 Texture Analyzer (from Texture Technologies Corp.) equipped with a 25.4 mm diameter polycarbonate test probe. The molded matrix is placed facial side down on the Texture Analyzer stage. Deformation Resistance DR is measured by advancing the polycarbonate probe downward at 10 mm/sec against the center of the molded test matrix over a distance of 25 mm. Using five molded test matrix samples, the maximum (peak) force is recorded and averaged to establish Deformation Resistance DR. Deformation Resistance DR preferably is at least about 75 g and more preferably at least about 200 g. We are not aware of a formula for converting King Stiffness values to Deformation Resistance values, but can observe that the King Stiffness test is somewhat more sensitive than the Deformation Resistance test when evaluating low stiffness molded matrices.

When exposed to a 0.075 μm sodium chloride aerosol flowing at 85 liters/min, the disclosed molded respirator preferably has a pressure drop less than 20 mm $H_2O$ and more preferably less than 10 mm $H_2O$. When so evaluated, the molded respirator also preferably has a % NaCl penetration less than about 5%, and more preferably less than about 1%.

FIG. 2 through FIG. 9 illustrate a variety of processes and equipment which may be used to make preferred monocomponent monolayer webs. The process shown in FIG. 2 through FIG. 5 combines larger size meltspun fibers from a meltspinning die and smaller size meltblown fibers from a meltblowing die. The process shown in FIG. 6 combines larger size and smaller size meltblown fibers from two meltblowing dies. The die shown in FIG. 7 produces larger size and smaller size meltspun fibers from a single meltspinning die which may be supplied with liquefied fiber-forming material from a single extruder. The die shown in FIG. 8 produces larger size and smaller size meltblown fibers from a single meltblowing die which may be supplied with liquefied fiber-forming material from a single extruder. The die shown in FIG. 9 produces larger size and smaller size meltspun fibers from a single meltspinning die which may be supplied with liquefied fiber-forming material from two extruders. The die shown in FIG. 10 and FIG. 11 produces larger size and smaller size meltblown fibers from a single meltblowing die which may be supplied with liquefied fiber-forming material from two extruders.

Figure 2:
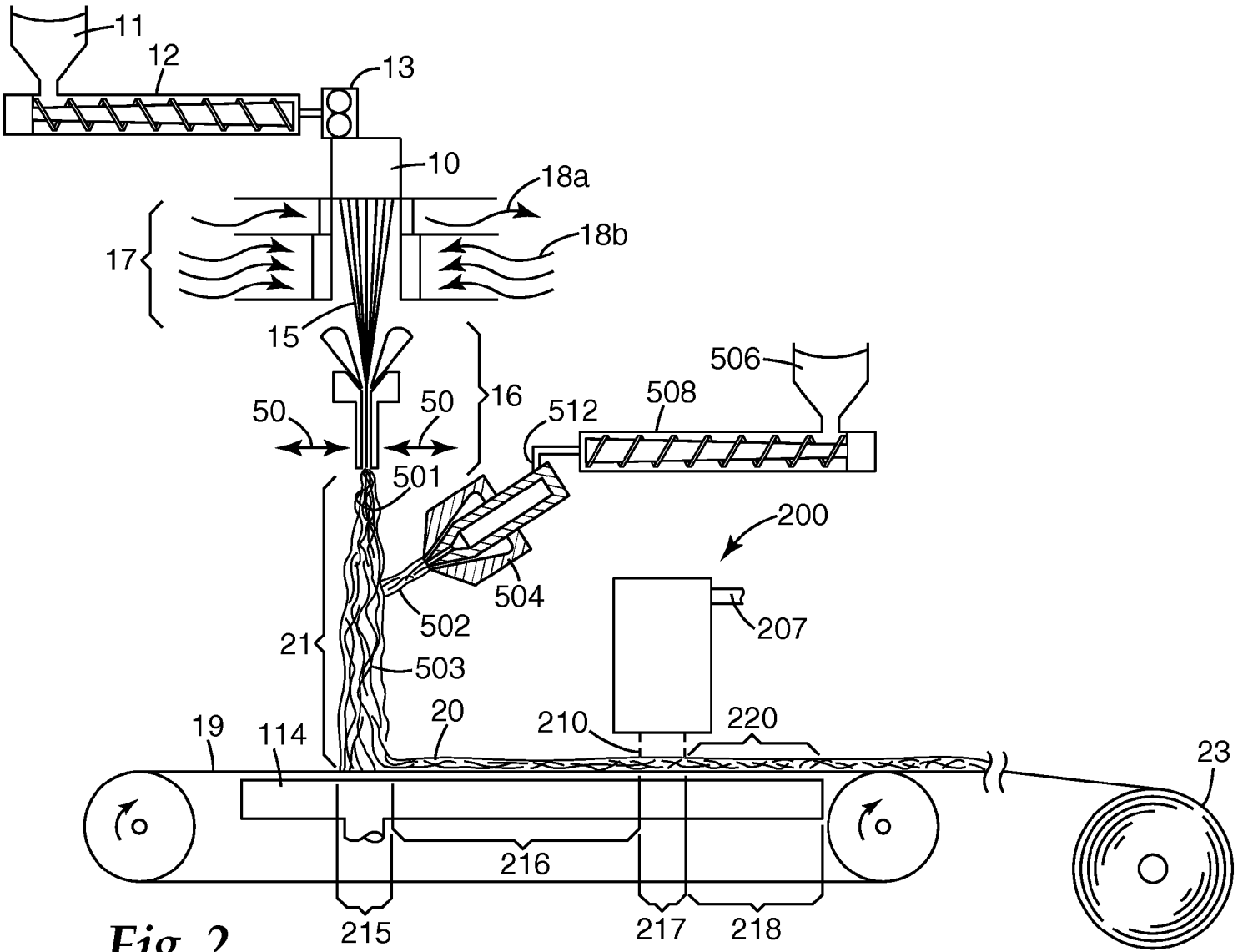
FIG. 2 through FIG. 4 are schematic side views.

Referring to FIG. 2, a process is shown in schematic side view for making a moldable monocomponent monolayer bimodal mass fraction/fiber size web using meltspinning to form larger size fibers and meltblowing to form separately prepared smaller size fibers (e.g., microfibers) of the same polymeric composition. Further details regarding this process and the nonwoven webs so made are shown in U.S. patent application Ser. No. 11/457,906, filed even date herewith and entitled "FIBROUS WEB COMPRISING MICROFIBERS DISPERSED AMONG BONDED MELTSPUN FIBERS", the entire disclosure of which is incorporated herein by reference. In the apparatus shown in FIG. 2, a fiber-forming material is brought to a melt-spinning extrusion head 10—in this illustrative apparatus, by introducing a polymeric fiber-forming material into a hopper 11, melting the material in an extruder 12, and pumping the molten material into the extrusion head 10 through a pump 13. Solid polymeric material in pellet or other particulate form is most commonly used and melted to a liquid, pumpable state.

The extrusion head 10 may be a conventional spinnerette or spin pack, generally including multiple orifices arranged in a regular pattern, e.g., straight-line rows. Filaments 15 of fiber-forming liquid are extruded from extrusion head 10 and conveyed to a processing chamber or attenuator 16. The attenuator may for example be a movable-wall attenuator like that shown in U.S. Pat. No. 6,607,624 B2 (Berrigan et al.) whose walls are mounted for free and easy movement in the direction of the arrows 50. The distance 17 the extruded filaments 15 travel before reaching the attenuator 16 can vary, as can the conditions to which they are exposed. Quenching streams of air or other gas 18 may be presented to the extruded filaments to reduce the temperature of the extruded filaments 15. Alternatively, the streams of air or other gas may be heated to facilitate drawing of the fibers. There may be one or more streams of air or other fluid—e.g., a first air stream 18a blown transversely to the filament stream, which may remove undesired gaseous materials or fumes released during extrusion; and a second quenching air stream 18*b* that achieves a major desired temperature reduction. Even more quenching streams may be used; for example, the stream 18*b* could itself include more than one stream to achieve a desired level of quenching. Depending on the process being used or the form of finished product desired, the quenching air may be sufficient to solidify the extruded filaments 15 before they reach the attenuator 16. In other cases the extruded filaments are still in a softened or molten condition when they enter the attenuator. Alternatively, no quenching streams are used; in such a case ambient air or other fluid between the extrusion head 10 and the attenuator 16 may be a medium for any change in the extruded filaments before they enter the attenuator.

The continuous meltspun filaments 15 are oriented in attenuator 16 which are directed toward collector 19 as a stream 501 of larger size fibers (that is, larger in relation to the smaller size meltspun fibers that will be added to the web; the fibers in attenuated stream 501 are smaller in size than the filaments extruded from extrusion head 10). On its course between attenuator 16 and collector 19, the attenuated larger size fiber stream 501 is intercepted by a stream 502 of meltblown smaller size fibers emanating from meltblowing die 504 to form a merged bimodal mass fraction/fiber size stream 503 of larger and smaller size fibers. The merged stream becomes deposited on collector 19 as a self-supporting web 20 containing oriented continuous meltspun larger size fibers with meltblown smaller size fibers dispersed therein. The collector 19 is generally porous and a gas-withdrawal device 114 can be positioned below the collector to assist deposition of fibers onto the collector. The distance 21 between the attenuator exit and the collector may be varied to obtain different effects. Also, prior to collection, the extruded filaments or fibers may be subjected to a number of additional processing steps not illustrated in FIG. 2, e.g., further drawing, spraying, etc. After collection the collected mass 20 may be heated and quenched as described in more detail below; conveyed to other apparatus such as calenders, embossing stations, laminators, cutters and the like; or it may merely be wound without further treatment or converting into a storage roll 23.

Figure 3:
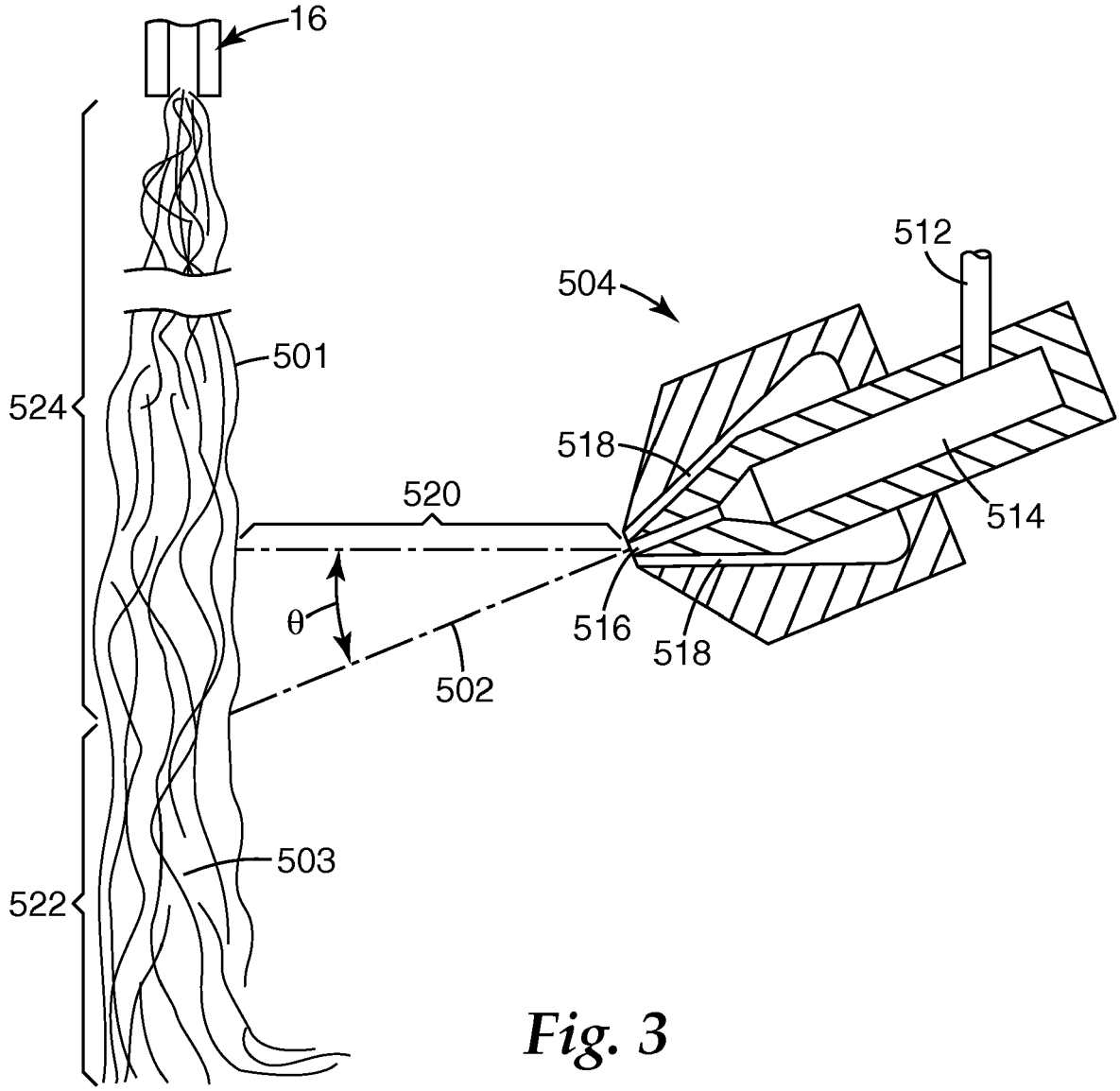

The meltblowing die 504 can be of known structure and operated in known ways to produce meltblown smaller size fibers (e.g., microfibers) for use in the disclosed process. An early description of the basic meltblowing method and apparatus is found in Wente, Van A. "Superfine Thermoplastic Fibers," in Industrial Engineering Chemistry, Vol. 48, pages 1342 et seq. (1956), or in Report No. 4364 of the Naval Research Laboratories, published May 25, 1954, entitled "Manufacture of Superfine Organic Fibers" by Wente, V. A.; Boone, C. D.; and Fluharty, E. L. The typical meltblowing apparatus includes a hopper 506 and extruder 508 supplying liquefied fiber-forming material to die 504. Referring to FIG. 3, die 504 includes an inlet 512 and die cavity 514 through which liquefied fiber-forming material is delivered to die orifices 516 arranged in line across the forward end of the die and through which the fiber-forming material is extruded; and cooperating gas orifices 518 through which a gas, typically heated air, is forced at very high velocity. The high-velocity gaseous stream draws out and attenuates the extruded fiber-forming material, whereupon the fiber-forming material solidifies (to varying degrees of solidity) and forms a stream 502 of meltblown smaller size fibers during travel to its point of merger with the meltspun larger size fiber stream 501.

Methods for meltblowing fibers of very small size including submicron sizes are known; see, for example, U.S. Pat. No. 5,993,943 (Bodaghi et al.), e.g., at column 8, line 11 through column 9, line 25. Other techniques to form smaller size fibers can also be used, for example, as described in U.S. Pat. No. 6,743,273 B2 (Chung et al.) and U.S. Pat. No. 6,800,226 B1 (Gerking).

The meltblowing die 504 is preferably positioned near the stream 501 of meltspun larger size fibers to best achieve capture of the meltblown smaller size fibers by the meltspun larger size fibers; close placement of the meltblowing die to the meltspun stream is especially important for capture of submicron microfibers. For example, as shown in FIG. 3 the distance 520 from the exit of the die 504 to the centerline of the meltspun stream 501 is preferably about 2 to 12 in. (5 to 25 cm) and more preferably about 6 or 8 in. (15 or 20 cm) or less for very small microfibers. Also, when the stream 501 of meltspun fibers is disposed vertically as shown in FIG. 3, the stream 502 of meltblown smaller size fibers is preferably disposed at an acute angle θ with respect to the horizontal, so that a vector of the meltblown stream 502 is directionally aligned with the meltspun stream 501. Preferably, θ is between about 0 and about 45 degrees and more preferably between about 10 and about 30 degrees. The distance 522 from the point of joinder of the meltblown and meltspun streams to the collector 19 is typically at least about 4 in. (10 cm) but less than about 16 in. (40 cm) to avoid over-entangling and to retain web uniformity. The distance 524 is sufficient, generally at least 6 in. (15 cm), for the momentum of the meltspun stream 501 to be reduced and thereby allow the meltblown stream 502 to better merge with the meltspun stream 501. As the streams of meltblown and meltspun fibers merge, the meltblown fibers become dispersed among the meltspun fibers. A rather uniform mixture is obtained, especially in the x-y (in-plane web) dimensions, with the distribution in the z dimension being controlled by particular process steps such as control of the distance 520, the angle θ, and the mass and velocity of the merging streams. The merged stream 503 continues to the collector 19 and there is collected as the web-like mass 20.

Depending on the condition of the meltspun and meltblown fibers, some bonding may occur between the fibers during collection. However, further bonding between the meltspun fibers in the collected web may be needed to provide a matrix having a desired degree of coherency and stiffness, making the web more handleable and better able to hold the meltblown fibers within the matrix. However, excessive bonding should be avoided so as to facilitate forming the web into a molded matrix.

Conventional bonding techniques using heat and pressure applied in a point-bonding process or by smooth calender rolls can be used, though such processes may cause undesired deformation of fibers or compaction of the web. A more preferred technique for bonding the meltspun fibers is taught in U.S. patent application Ser. No. 11/457,899, filed even date herewith and entitled "BONDED NONWOVEN FIBROUS WEBS COMPRISING SOFTENABLE ORIENTED SEMICRYSTALLINE POLYMERIC FIBERS AND APPARATUS AND METHODS FOR PREPARING SUCH WEBS", the entire disclosure of which is incorporated herein by reference. In brief summary, as applied to the present invention, this preferred technique involves subjecting a collected web of oriented semicrystalline meltspun fibers which include an amorphous-characterized phase, intermingled with meltblown fibers of the same polymeric composition, to a controlled heating and quenching operation that includes a) forcefully passing through the web a fluid heated to a temperature high enough to soften the amorphous-characterized phase of the meltspun fibers (which is generally greater than the onset melting temperature of the material of such fibers) for a time too short to melt the whole meltspun fibers (viz., causing such fibers to lose their discrete fibrous nature; preferably, the time of heating is too short to cause a significant distortion of the fiber cross-section), and b) immediately quenching the web by forcefully passing through the web a fluid having sufficient heat capacity to solidify the softened fibers (viz., to solidify the amorphous-characterized phase of the fibers softened during heat treatment). Preferably the fluids passed through the web are gaseous streams, and preferably they are air. In this context "forcefully" passing a fluid or gaseous stream through a web means that a force in addition to normal room pressure is applied to the fluid to propel the fluid through the web. In a preferred embodiment, the disclosed quenching step includes passing the web on a conveyor through a device we term a quenched flow heater, or, more simply, quenched heater. As illustrated herein, such a quenched flow heater provides a focused or knife-like heated gaseous (typically air) stream issuing from the heater under pressure and engaging one side of the web, with a gas-withdrawal device on the other side of the web to assist in drawing the heated gas through the web; generally the heated stream extends across the width of the web. The heated stream is much like the heated stream from a conventional "through-air bonder" or "hot-air knife," but it is subjected to special controls that modulate the flow, causing the heated gas to be distributed uniformly and at a controlled rate through the width of the web to thoroughly, uniformly and rapidly heat and soften the meltspun fibers to a usefully high temperature. Forceful quenching immediately follows the heating to rapidly freeze the fibers in a purified morphological form ("immediately" means as part of the same operation, i.e., without an intervening time of storage as occurs when a web is wound into a roll before the next processing step). In a preferred embodiment the gas-withdrawal device is positioned downweb from the heated gaseous stream so as to draw a cooling gas or other fluid, e.g., ambient air, through the web promptly after it has been heated and thereby rapidly quench the fibers. The length of heating is controlled, e.g., by the length of the heating region along the path of web travel and by the speed at which the web is moved through the heating region to the cooling region, to cause the intended melting/softening of the amorphous-characterizing phase without melting whole meltspun fiber.

Figure 4:
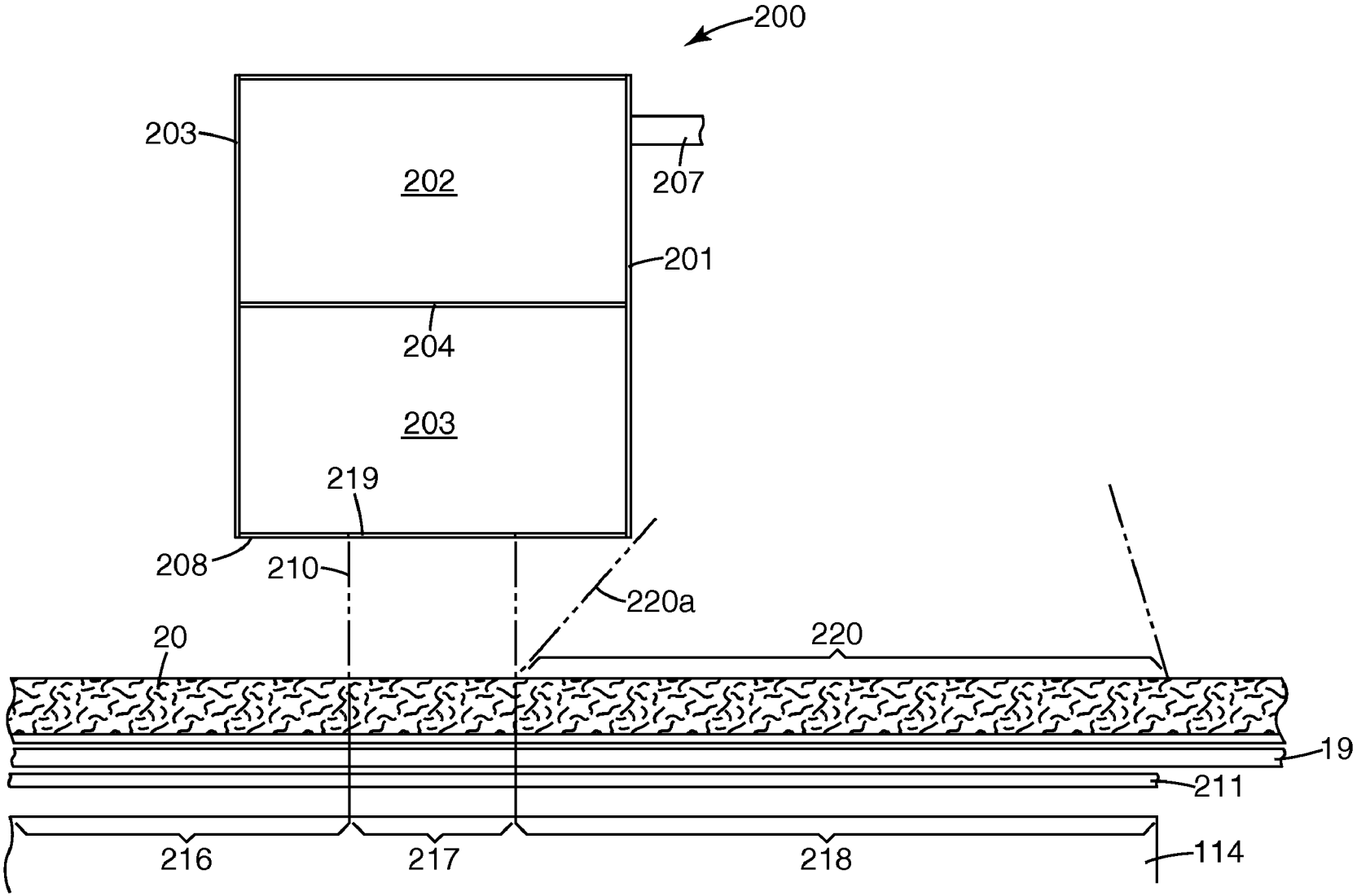
Figure 5:
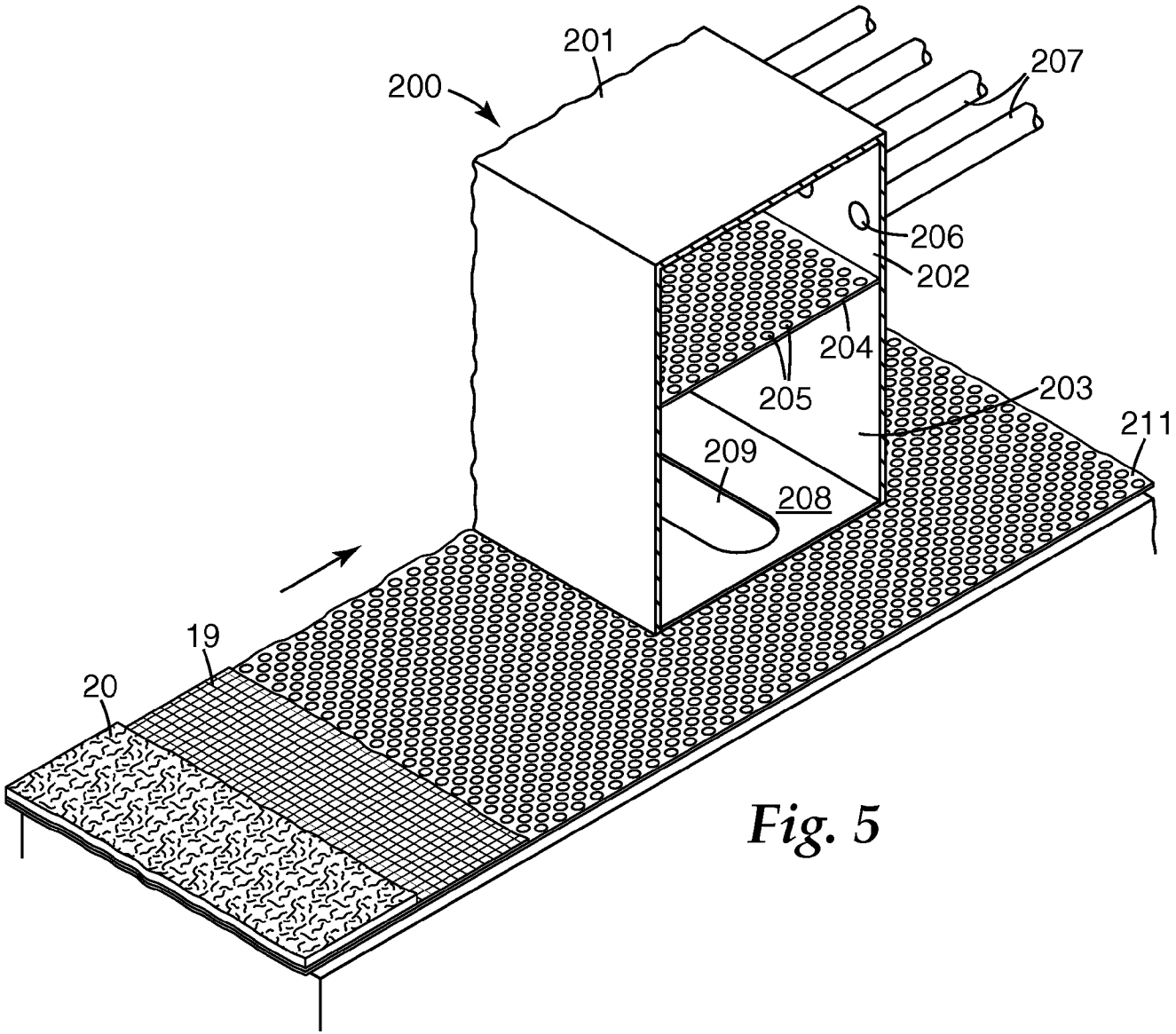
FIG. 5 is a schematic perspective view, partially in section, of an exemplary process for making a monocomponent monolayer web using meltspinning and separately prepared smaller size fibers of the same polymeric composition.

Referring to FIG. 2, FIG. 4 and FIG. 5, in one exemplary method for carrying out the quenched flow heating technique, the mass 20 of collected meltspun and meltblown fibers is carried by the moving collector 19 under a controlled-heating device 200 mounted above the collector 19. The exemplary heating device 200 comprises a housing 201 which is divided into an upper plenum 202 and a lower plenum 203. The upper and lower plenums are separated by a plate 204 perforated with a series of holes 205 that are typically uniform in size and spacing. A gas, typically air, is fed into the upper plenum 202 through openings 206 from conduits 207, and the plate 204 functions as a flow-distribution means to cause air fed into the upper plenum to be rather uniformly distributed when passed through the plate into the lower plenum 203. Other useful flow-distribution means include fins, baffles, manifolds, air dams, screens or sintered plates, viz., devices that even the distribution of air.

In the illustrative heating device 200 the bottom wall 208 of the lower plenum 203 is formed with an elongated slot 209 through which an elongated or knife-like stream 210 of heated air from the lower plenum is blown onto the mass 20 traveling on the collector 19 below the heating device 200 (the mass 20 and collector 19 are shown partly broken away in FIG. 5). The gas-withdrawal device 114 preferably extends sufficiently to lie under the slot 209 of the heating device 200 (as well as extending downweb a distance 218 beyond the heated stream 210 and through an area marked 220, as will be discussed below). Heated air in the plenum is thus under an internal pressure within the plenum 203, and at the slot 209 it is further under the exhaust vacuum of the gas-withdrawal device 114. To further control the exhaust force a perforated plate 211 may be positioned under the collector 19 to impose a kind of back pressure or flow-restriction means which assures the stream 210 of heated air will spread to a desired extent over the width or heated area of the collected mass 20 and be inhibited in streaming through possible lower-density portions of the collected mass. Other useful flow-restriction means include screens or sintered plates. The number, size and density of openings in the plate 211 may be varied in different areas to achieve desired control. Large amounts of air pass through the fiber-forming apparatus and must be disposed of as the fibers reach the collector in the region 215. Sufficient air passes through the web and collector in the region 216 to hold the web in place under the various streams of processing air. Sufficient openness is needed in the plate under the heating region 217 to allow treating air to pass through the web, while sufficient resistance is provided to assure that the air is evenly distributed. The temperature-time conditions should be controlled over the whole heated area of the mass. We have obtained best results when the temperature of the stream 210 of heated air passing through the web is within a range of 5° C., and preferably within 2 or even 1° C., across the width of the mass being treated (the temperature of the heated air is often measured for convenient control of the operation at the entry point for the heated air into the housing 201, but it also can be measured adjacent the collected web with thermocouples). In addition, the heating apparatus is operated to maintain a steady temperature in the stream over time, e.g., by rapidly cycling the heater on and off to avoid over- or under-heating. To further control heating, the mass 20 is subjected to quenching quickly after the application of the stream 210 of heated air. Such a quenching can generally be obtained by drawing ambient air over and through the mass 20 immediately after the mass leaves the controlled hot air stream 210. Numeral 220 in FIG. 4 represents an area in which ambient air is drawn through the web by the gas-withdrawal device 114 after the web has passed through the hot air stream. Actually, such air can be drawn under the base of the housing 201, e.g., in the area 220*a* marked on FIG. 4, so that it reaches the web almost immediately after the web leaves the hot air stream 210. And the gas-withdrawal device 114 may extend along the collector 19 for a distance 218 beyond the heating device 200 to assure thorough cooling and quenching of the whole mass 20. For shorthand purposes the combined heating and quenching apparatus is termed a quenched flow heater.

The amount and temperature of heated air passed through the mass 20 is chosen to lead to an appropriate modification of the morphology of the larger size fibers. Particularly, the amount and temperature are chosen so that the larger size fibers are heated to a) cause melting/softening of significant molecular portions within a cross-section of the fiber, e.g., the amorphous-characterized phase of the fiber, but b) will not cause complete melting of another significant phase, e.g., the crystallite-characterized phase. We use the term "melting/softening" because amorphous polymeric material typically softens rather than melts, while crystalline material, which may be present to some degree in the amorphous-characterized phase, typically melts. This can also be stated, without reference to phases, simply as heating to cause melting of lower-order crystallites within the fiber. The larger size fibers as a whole remain unmelted, e.g., the fibers generally retain the same fiber shape and dimensions as they had before treatment. Substantial portions of the crystallite-characterized phase are understood to retain their pre-existing crystal structure after the heat treatment. Crystal structure may have been added to the existing crystal structure, or in the case of highly ordered fibers crystal structure may have been removed to create distinguishable amorphous-characterized and crystallite-characterized phases.

One aim of the quenching is to withdraw heat before undesired changes occur in the smaller size fibers contained in the web. Another aim of the quenching is to rapidly remove heat from the web and the larger size fibers and thereby limit the extent and nature of crystallization or molecular ordering that will subsequently occur in the larger size fibers. By rapid quenching from the molten/softened state to a solidified state, the amorphous-characterized phase is understood to be frozen into a more purified crystalline form, with reduced lower-order molecular material that can interfere with softening, or repeatable softening, of the larger size fibers. For such purposes, desirably the mass 20 is cooled by a gas at a temperature at least 50° C. less than the Nominal Melting Point or the larger size fibers; also the quenching gas is desirably applied for a time on the order of at least one second. In any event the quenching gas or other fluid has sufficient heat capacity to rapidly solidify the fibers.

An advantage of the disclosed quenched flow heater is that the smaller size meltblown fibers held within the disclosed web are better protected against compaction than they would be if present in a layer made up entirely of smaller size fibers (e.g., entirely of microfibers). The oriented meltspun fibers are generally larger, stiffer and stronger than the meltblown smaller size fibers, and the presence of the meltspun fibers between the meltblown fibers and an object applying pressure limits application of crushing force on the smaller size meltblown fibers. Especially in the case of submicron fibers, which can be quite fragile, the increased resistance against compaction or crushing provided by the larger size fibers offers an important benefit. Even when the disclosed webs are subjected to pressure, e.g., by being rolled up in jumbo storage rolls or in secondary processing, the webs offer good resistance to compaction, which could otherwise lead to increased pressure drop and poor loading performance for filters made from such webs. The presence of the larger size meltspun fibers also adds other properties such as web strength, stiffness and handling properties.

It has been found that the meltblown smaller size fibers do not substantially melt or lose their fiber structure during the bonding operation, but remain as discrete smaller size fibers with their original fiber dimensions. Meltblown fibers have a different, less crystalline morphology than meltspun fibers, and we theorize that the limited heat applied to the web during the bonding and quenching operation is exhausted in developing crystalline growth within the meltblown fibers before melting of the meltblown fibers occurs. Whether this theory is correct or not, bonding of the meltspun fibers without substantial melting or distortion of the meltblown smaller size fibers does occur and is beneficial to the properties of the finished bimodal mass fraction/fiber size web.

Figure 6:
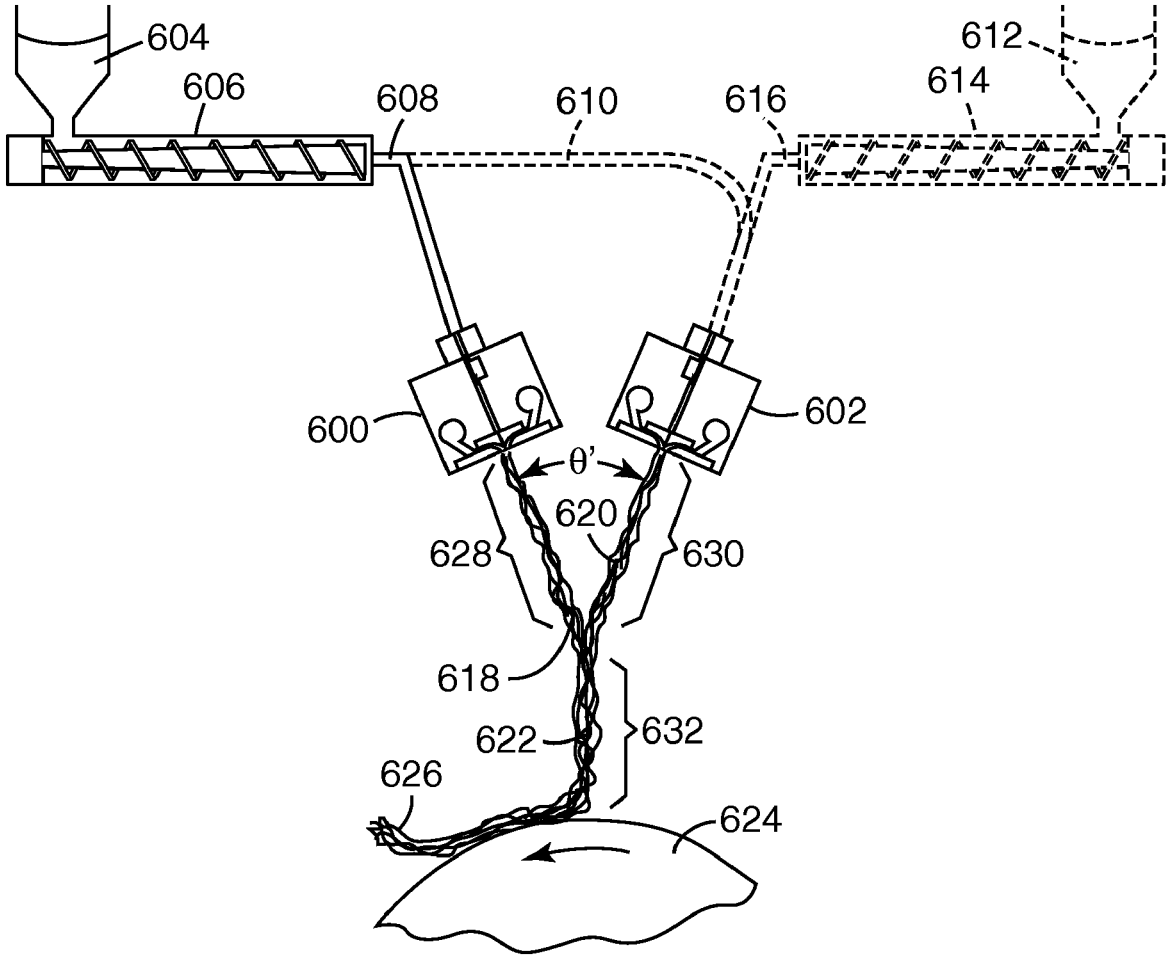
FIG. 6 is a schematic side view of an exemplary process for making a monocomponent monolayer web using meltblowing of larger fibers and separately prepared smaller size fibers of the same polymeric composition.

Referring to FIG. 6, another process is shown in schematic side view for making a moldable monocomponent monolayer bimodal mass fraction/fiber size web using meltblowing to form both larger size fibers and separately prepared smaller size fibers of the same polymeric composition. The FIG. 6 apparatus employs two meltblowing dies 600 and 602. Die 600 is supplied with liquefied fiber-forming material fed from hopper 604, extruder 606 and conduit 608. Die 602 may also be supplied with liquefied fiber-forming material from extruder 606 via optional conduit 610. Alternatively, die 602 may be separately supplied with liquefied fiber-forming material of the same polymeric composition fed from optional hopper 612, extruder 614 and conduit 616. Larger size fiber stream 618 from die 600 and smaller size fiber stream 620 from die 602 merge in flight to provide a stream 622 of intermingled larger fibers and smaller fibers which can land on rotating collector drum 624 to provide a self-supporting nonwoven web 626 containing a bimodal mass fraction/fiber size mixture of such fibers. The apparatus shown in FIG. 6 may be operated in several modes to provide a stream of larger size fibers from one die and smaller size fibers from the other die. For example, the same polymer may be supplied from a single extruder to die 600 and die 602 with larger size orifices being provided in die 600 and smaller size orifices being provided in die 602 so as to enable production of larger size fibers at die 600 and smaller size fibers at die 602. Identical polymers may be supplied from extruder 606 to die 600 and from extruder 614 to die 602, with extruder 614 having a larger diameter or higher operating temperature than extruder 606 so as to supply the polymer at a higher flow rate or lower viscosity into die 602 and enable production of larger size fibers at die 600 and smaller size fibers at die 602. Similar size orifices may be provided in die 600 and die 602 with die 600 being operated at a low temperature and die 602 being operated at a high temperature so as to produce larger size fibers at die 600 and smaller size fibers at die 602. Polymers of the same polymeric composition but different melt indices may be supplied from extruder 606 to die 600 and from extruder 614 to die 602 (using for example a low melt index version of the polymer in extruder 606 and a high melt index of the same polymer in extruder 614) so as to produce larger size fibers at die 600 and smaller size fibers at die 602. Those having ordinary skill in the art will appreciate that other techniques (e.g., the inclusion of a solvent in the stream of liquefied fiber-forming material flowing to die 602, or the use of die cavities with a shorter flow path in die 600 and a longer flow path in die 602) and combinations of such techniques and the various operating modes discussed above may also be employed. The meltblowing dies 600 and 602 preferably are positioned so that the larger size fiber stream 618 and smaller size fiber stream 620 adequately intermingle. For example, the distance 628 from the exit of larger size fiber die 600 to the centerline of the merged fiber stream 622 is preferably about 2 to about 12 in. (about 5 to about 25 cm) and more preferably about 6 to about 8 in. (about 15 to about 20 cm). The distance 630 from the exit of smaller size fiber die 602 to the centerline of the merged fiber stream 622 preferably is about 2 to about 12 in. (about 5 to about 25 cm) and more preferably about 6 to about 8 in. (about 15 to about 20 cm) or less for very small microfibers. The distances 628 and 630 need not be the same. Also, the stream 618 of larger size fibers is preferably disposed at an acute angle θ' to the stream 620 of smaller size fibers. Preferably, θ' is between about 0 and about 45 degrees and more preferably between about 10 and about 30 degrees. The distance 632 from the approximate point of joinder of the larger and smaller size fiber streams to the collector drum 624 is typically at least about 5 in. (13 cm) but less than about 15 in. (38 cm) to avoid over-entangling and to retain web uniformity.

Figure 7:
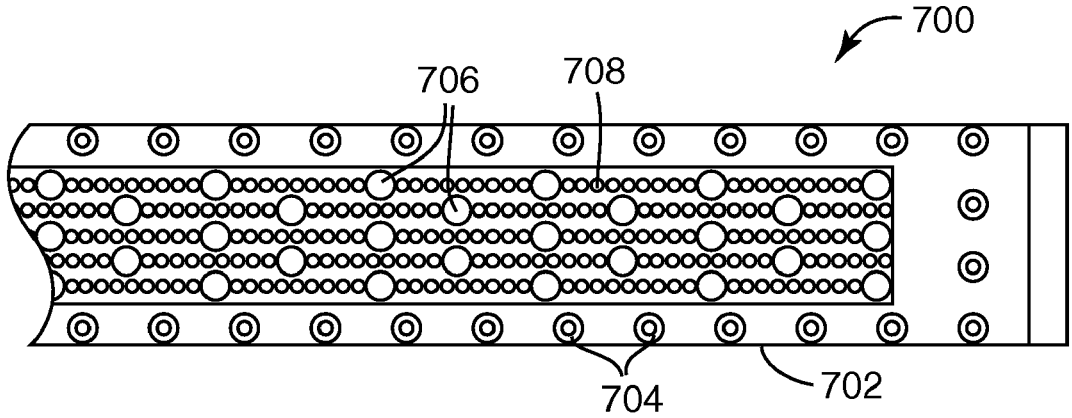
FIG. 7 is an outlet end view of an exemplary meltspinning die spinneret having a plurality of larger and smaller orifices.

Referring to FIG. 7, a meltspinning die spinneret 700 for use in making a moldable monocomponent monolayer bimodal mass fraction/fiber size web via yet another process is shown in outlet end view. Spinneret 700 includes a body member 702 held in place with bolts 704. An array of larger orifices 706 and smaller orifices 708 define a plurality of flow passages through which liquefied fiber-forming material exits spinneret 700 and forms filaments. In the embodiment shown in FIG. 7, the larger orifices 706 and smaller orifices 708 have a 2:1 size ratio and there are 9 smaller orifices 708 for each larger orifice 706. Other ratios of larger:smaller orifice sizes may be used, for example ratios of 1:1 or more, 1.5:1 or more, 2:1 or more, 2.5:1 or more, 3:1 or more, or 3.5:1 or more. Other ratios of the number of smaller orifices per larger orifice may also be used, for example ratios of 5:1 or more, 6:1 or more, 10:1 or more, 12:1 or more, 15:1 or more, 20:1 or more or 30:1 or more. Typically there will be a direct correspondence between the number of smaller orifices per larger orifice and the number of smaller size fibers (e.g., microfibers under appropriate operating conditions) per larger size fiber in the collected web. As will be appreciated by persons having ordinary skill in the art, appropriate polymer flow rates, die operating temperatures and orienting conditions should be chosen so that smaller size fibers are produced from oriented filaments formed by the smaller orifices, larger size fibers are produced from oriented filaments formed by the larger orifices, and the completed web has the desired properties. The remaining portions of the associated meltspinning apparatus will be familiar to those having ordinary skill in the art.

Figure 8:
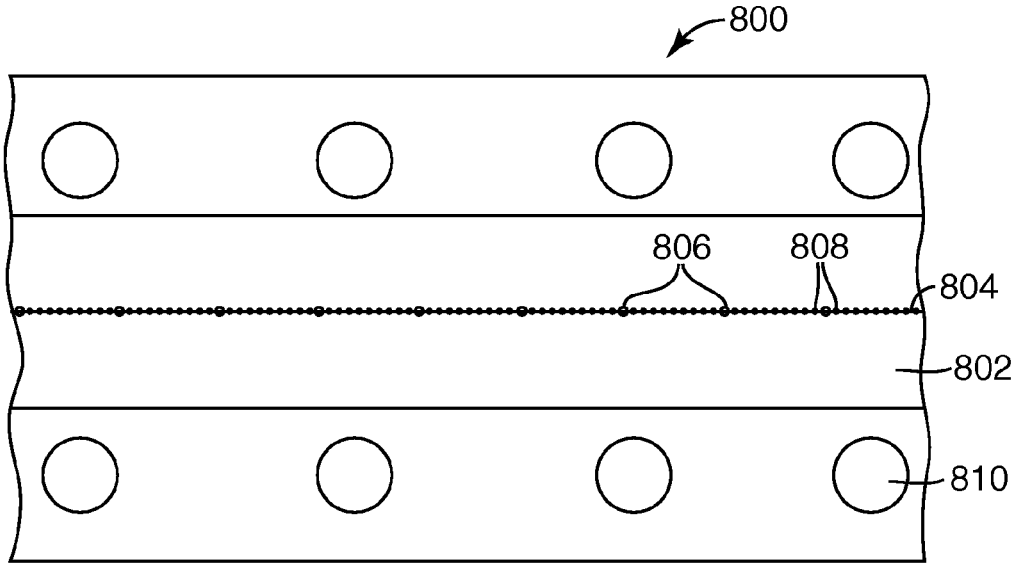
FIG. 8 is an outlet end perspective view of an exemplary meltblowing die having a plurality of larger and smaller orifices.

Referring to FIG. 8, a meltblowing die 800 for use in making a moldable monocomponent monolayer bimodal mass fraction/fiber size web via yet another process is shown in outlet end perspective view, with the secondary attenuating gas deflector plates removed. Die 800 includes a projecting tip portion 802 with a row 804 of larger orifices 806 and smaller orifices 808 which define a plurality of flow passages through which liquefied fiber-forming material exits die 800 and forms filaments. Holes 810 receive through-bolts (not shown in FIG. 8) which hold the various parts of the die together. In the embodiment shown in FIG. 8, the larger orifices 806 and smaller orifices 808 have a 2:1 size ratio and there are 9 smaller orifices 808 for each larger orifice 806. Other ratios of larger:smaller orifice sizes may be used, for example ratios of 1.5:1 or more, 2:1 or more, 2.5:1 or more, 3:1 or more, or 3.5:1 or more. Other ratios of the number of smaller orifices per larger orifice may also be used, for example ratios of 5:1 or more, 6:1 or more, 10:1 or more, 12:1 or more, 15:1 or more, 20:1 or more or 30:1 or more. Typically there will be a direct correspondence between the number of smaller orifices per larger orifice and the number of smaller size fibers (e.g., microfibers under appropriate operating conditions) per larger size fiber in the collected web. As will be appreciated by persons having ordinary skill in the art, appropriate polymer flow rates, die operating temperatures and attenuating airflow rates should be chosen so that smaller size fibers are produced from attenuated filaments formed by the smaller orifices, larger size fibers are produced from attenuated filaments formed by the larger orifices, and the completed web has the desired properties. Further details regarding the associated process and the nonwoven webs so made are shown in U.S. patent application Ser. No. 11/461,136, filed even date herewith and entitled "MONOCOMPONENT MONOLAYER MELTBLOWN WEB AND MELTBLOWING APPARATUS", the entire disclosure of which is incorporated herein by reference.

Figure 9:
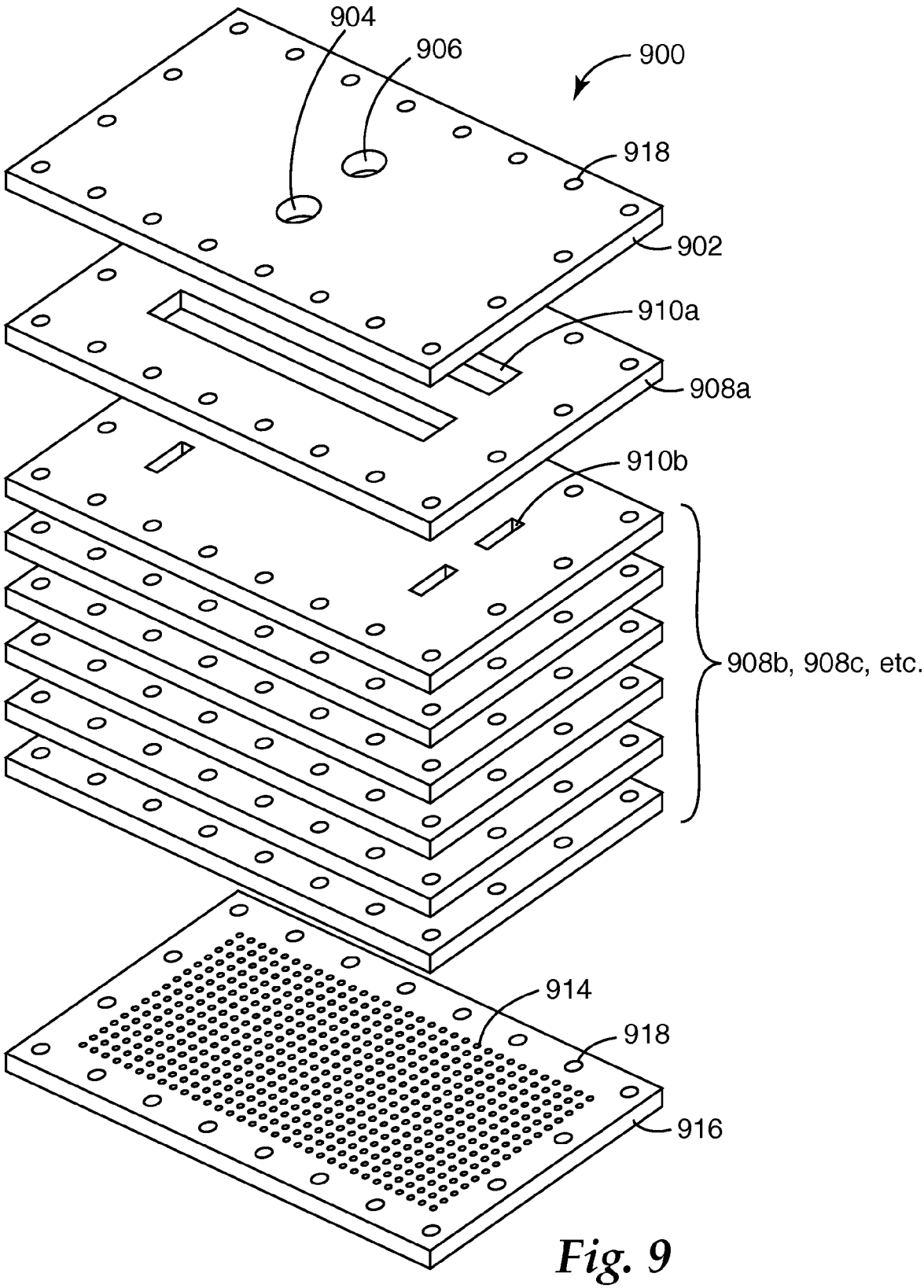
FIG. 9 is an exploded schematic view of an exemplary meltspinning die having a plurality of orifices supplied with polymers of the same polymeric composition flowing at different rates or with different viscosities.

Referring to FIG. 9, a meltspinning die 900 for use in making a moldable monocomponent monolayer bimodal mass fraction/fiber size web via yet another process is shown in exploded schematic view. Die 900 may be referred to as a "plate die", "shim die" or "stack die", and includes an inlet plate 902 whose fluid inlets 904 and 906 each receive a stream of liquefied fiber-forming material. The streams have the same polymeric composition but different flow rates or different melt viscosities. The polymer streams flow through a series of intermediate plates 908*a*, 908*b*, etc. whose passages 910*a*, 910*b*, etc. repeatedly divide the streams. The thus serially-divided streams flow through a plurality (e.g., 256, 512 or some other multiple of the number of fluid inlets) of fluid outlet orifices 914 in outlet plate 916. The various plates may be fastened together via bolts or other fasteners (not shown in FIG. 9) through holes 918. Each fluid outlet orifice 914 will communicate via a unique flow path with one or the other of the fluid inlets 904 or 906. The remaining portions of the associated meltspinning apparatus will be familiar to those having ordinary skill in the art, and may be used to process the liquefied fiber-forming materials into a nonwoven web of meltspun filaments having a bimodal mass fraction/fiber size mixture of intermingled larger size fibers and smaller size fibers of the same polymeric composition.

Figure 10:
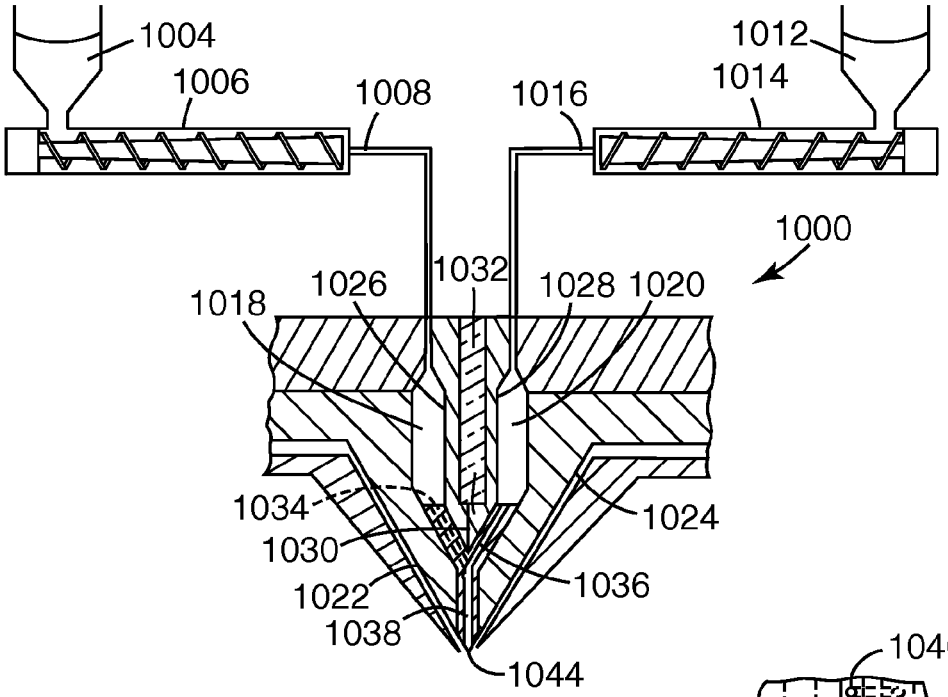
FIG. 10 is a cross-sectional view.
Figure 11:
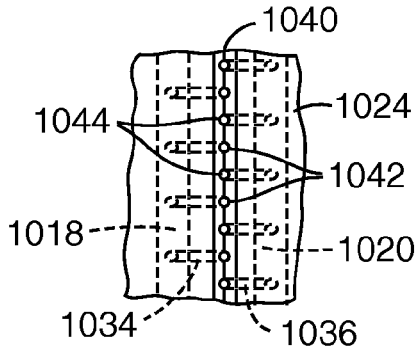
FIG. 11 is an outlet end view of an exemplary meltblowing die having a plurality of orifices supplied with polymers of the same polymeric composition flowing at different rates or with different viscosities.

Referring to FIG. 10 and FIG. 11, meltblowing die 1000 for use in making a moldable monocomponent monolayer bimodal mass fraction/fiber size web via yet another process is shown in cross-sectional and outlet end view. Die 1000 is supplied with liquefied fiber-forming material fed from hopper 1004, extruder 1006 and conduit 1008 at a first flow rate or first viscosity. Die 1000 is separately supplied with liquefied fiber-forming material of the same polymeric composition fed from hopper 1012, extruder 1014 and conduit 1016 at a second, different flow rate or viscosity. The conduits 1008 and 1016 are in respective fluid communication with first and second die cavities 1018 and 1020 located in first and second generally symmetrical parts 1022 and 1024 which form outer walls for die cavities 1018 and 1020. First and second generally symmetrical parts 1026 and 1028 form inner walls for die cavities 1018 and 1020 and meet at seam 1030. Parts 1026 and 1028 may be separated along most of their length by insulation 1032. As also shown in FIG. 11, die cavities 1018 and 1020 are in respective fluid communication via passages 1034, 1036 and 1038 with a row 1040 of orifices 1042 and 1044. Dependent upon the flow rates into die cavities 1018 and 1020, filaments of larger and smaller sizes may be extruded through the orifices 1042 and 1044, thereby enabling formation of a nonwoven web containing a bimodal mass fraction/fiber size mixture of intermingled larger size fibers and smaller size fibers of the same polymeric composition. The remaining portions of the associated meltblowing apparatus will be familiar to those having ordinary skill in the art, and may be used to process the liquefied fiber-forming materials into a nonwoven web of meltblown filaments having a bimodal mass fraction/fiber size mixture of intermingled larger size fibers and smaller size fibers of the same polymeric composition.

For the embodiment shown in FIG. 11, the orifices 1042 and 1044 are arranged in alternating order and are in respective fluid communication with the die cavities 1018 and 1020. As will be appreciated by persons having ordinary skill in the art, other arrangements of the orifices and other fluid communication ratios may be employed to provide nonwoven webs with altered fiber size distributions. Persons having ordinary skill in the art will also appreciate that other operating modes and techniques (e.g., like those discussed above in connection with the FIG. 6 apparatus) and combinations of such techniques and operating modes may also be employed.

The disclosed nonwoven webs may have a random fiber arrangement and generally isotropic in-plane physical properties (e.g., tensile strength), or if desired may have an aligned fiber construction (e.g., one in which the fibers are aligned in the machine direction as described in the above-mentioned Shah et al. U.S. Pat. No. 6,858,297) and anisotropic in-plane physical properties.

A variety of polymeric fiber-forming materials may be used in the disclosed process. The polymer may be essentially any thermoplastic fiber-forming material capable of providing a charged nonwoven web which will maintain satisfactory electret properties or charge separation. Preferred polymeric fiber-forming materials are non-conductive resins having a volume resistivity of $10^{14}$ ohm-centimeters or greater at room temperature (22° C.). Preferably, the volume resistivity is about $10^{16}$ ohm-centimeters or greater. Resistivity of the polymeric fiber-forming material may be measured according to standardized test ASTM D 257-93. The polymeric fiber-forming material also preferably is substantially free from components such as antistatic agents that could significantly increase electrical conductivity or otherwise interfere with the fiber's ability to accept and hold electrostatic charges. Some examples of polymers which may be used in chargeable webs include thermoplastic polymers containing polyolefins such as polyethylene, polypropylene, polybutylene, poly(4-methyl-1-pentene) and cyclic olefin copolymers, and combinations of such polymers. Other polymers which may be used but which may be difficult to charge or which may lose charge rapidly include polycarbonates, block copolymers such as styrene-butadiene-styrene and styrene-isoprene-styrene block copolymers, polyesters such as polyethylene terephthalate, polyamides, polyurethanes, and other polymers that will be familiar to those skilled in the art. The fibers preferably are prepared from poly-4-methyl-1 pentene or polypropylene. Most preferably, the fibers are prepared from polypropylene homopolymer because of its ability to retain electric charge, particularly in moist environments.

Electric charge can be imparted to the disclosed nonwoven webs in a variety of ways. This may be carried out, for example, by contacting the web with water as disclosed in U.S. Pat. No. 5,496,507 to Angadjivand et al., corona-treating as disclosed in U.S. Pat. No. 4,588,537 to Klasse et al., hydrocharging as disclosed, for example, in U.S. Pat. No. 5,908,598 to Rousseau et al., plasma treating as disclosed in U.S. Pat. No. 6,562,112 B2 to Jones et al. and U.S. Patent Application Publication No. US2003/0134515 A1 to David et al., or combinations thereof.

Additives may be added to the polymer to enhance the web's filtration performance, electret charging capability, mechanical properties, aging properties, coloration, surface properties or other characteristics of interest. Representative additives include fillers, nucleating agents (e.g., MILLAD™ 3988 dibenzylidene sorbitol, commercially available from Milliken Chemical), electret charging enhancement additives (e.g., tristearyl melamine, and various light stabilizers such as CHIMASSORB™ 119 and CHIMASSORB 944 from Ciba Specialty Chemicals), cure initiators, stiffening agents (e.g., poly(4-methyl-1-pentene)), surface active agents and surface treatments (e.g., fluorine atom treatments to improve filtration performance in an oily mist environment as described in U.S. Pat. Nos. 6,398,847 B1, 6,397,458 B1, and 6,409,806 B1 to Jones et al.). The types and amounts of such additives will be familiar to those skilled in the art. For example, electret charging enhancement additives are generally present in an amount less than about 5 wt. % and more typically less than about 2 wt. %.

The disclosed nonwoven webs may be formed into cup-shaped molded respirators using methods and components that will be familiar to those having ordinary skill in the art. The disclosed molded respirators may if desired include one or more additional layers other than the disclosed monolayer matrix. For example, inner or outer cover layers may be employed for comfort or aesthetic purposes and not for filtration or stiffening. Also, one or more porous layers containing sorbent particles may be employed to capture vapors of interest, such as the porous layers described in U.S. patent application Ser. No. 11/431,152 filed May 8, 2006 and entitled PARTICLE-CONTAINING FIBROUS WEB, the entire disclosure of which is incorporated herein by reference. Other layers (including stiffening layers or stiffening elements) may be included if desired even though not required to provide a molded respirator having the recited Deformation Resistance DR value.

It may be desirable to monitor flat web properties such as basis weight, web thickness, solidity, EFD, Gurley Stiffness, Taber Stiffness, pressure drop, initial % NaCl penetration, % DOP penetration or the Quality Factor QF, and to monitor molded matrix properties such as King Stiffness, Deformation Resistance DR or pressure drop. Molded matrix properties may be evaluated by forming a test cup-shaped matrix between mating male and female halves of a hemispherical mold having a 55 mm radius and a 310 $cm^3$ volume.

EFD may be determined (unless otherwise specified) using an air flow rate of 32 L/min (corresponding to a face velocity of 5.3 cm/sec), using the method set forth in Davies, C. N., "The Separation of Airborne Dust and Particles", Institution of Mechanical Engineers, London, Proceedings 1B, 1952.

Gurley Stiffness may be determined using a Model 4171E GURLEY™ Bending Resistance Tester from Gurley Precision Instruments. Rectangular 3.8 cm×5.1 cm rectangles are die cut from the webs with the sample long side aligned with the web transverse (cross-web) direction. The samples are loaded into the Bending Resistance Tester with the sample long side in the web holding clamp. The samples are flexed in both directions, viz., with the test arm pressed against the first major sample face and then against the second major sample face, and the average of the two measurements is recorded as the stiffness in milligrams. The test is treated as a destructive test and if further measurements are needed fresh samples are employed.

Taber Stiffness may be determined using a Model 150-B TABER™ stiffness tester (commercially available from Taber Industries). Square 3.8 cm×3.8 cm sections are carefully vivisected from the webs using a sharp razor blade to prevent fiber fusion, and evaluated to determine their stiffness in the machine and transverse directions using 3 to 4 samples and a 15° sample deflection.

Percent penetration, pressure drop and the filtration Quality Factor QF may be determined using a challenge aerosol containing NaCl or DOP particles, delivered (unless otherwise indicated) at a flow rate of 85 liters/min, and evaluated using a TSI™ Model 8130 high-speed automated filter tester (commercially available from TSI Inc.). For NaCl testing, the particles may generated from a 2% NaCl solution to provide an aerosol containing particles with a diameter of about 0.075 μm at an airborne concentration of about 16-23 $mg/m^3$, and the Automated Filter Tester may be operated with both the heater and particle neutralizer on. For DOP testing, the aerosol may contain particles with a diameter of about 0.185 μm at a concentration of about 100 $mg/m^3$, and the Automated Filter Tester may be operated with both the heater and particle neutralizer off. The samples may be loaded to the maximum NaCl or DOP particle penetration at a 13.8 cm/sec face velocity for flat web samples or an 85 liters/min flowrate for molded matrices before halting the test. Calibrated photometers may be employed at the filter inlet and outlet to measure the particle concentration and the % particle penetration through the filter. An MKS pressure transducer (commercially available from MKS Instruments) may be employed to measure pressure drop (ΔP, mm $H_2O$) through the filter. The equation:

$$QF = \frac{-\ln\left(\frac{\%\ \text{Particle Penetration}}{100}\right)}{\Delta P}$$

may be used to calculate QF. Parameters which may be measured or calculated for the chosen challenge aerosol include initial particle penetration, initial pressure drop, initial Quality Factor QF, maximum particle penetration, pressure drop at maximum penetration, and the milligrams of particle loading at maximum penetration (the total weight challenge to the filter up to the time of maximum penetration). The initial Quality Factor QF value usually provides a reliable indicator of overall performance, with higher initial QF values indicating better filtration performance and lower initial QF values indicating reduced filtration performance.

Deformation Resistance DR may be determined using a Model TA-XT2i/5 Texture Analyzer (from Texture Technologies Corp.) equipped with a 25.4 mm diameter polycarbonate test probe. A molded test matrix (prepared as described above in the definition for King Stiffness) is placed facial side down on the Texture Analyzer stage. Deformation resistance is measured by advancing the polycarbonate probe downward at 10 mm/sec against the center of the molded test matrix over a distance of 25 mm. Using five molded test matrix samples, the maximum (peak) force is recorded and averaged to establish the DR value.

The invention is further illustrated in the following illustrative examples, in which all parts and percentages are by weight unless otherwise indicated.

EXAMPLE 1

Four webs were prepared using an apparatus as shown in FIG. 2 through FIG. 5 from polypropylene meltspun fibers and polypropylene meltblown microfibers. The meltspun fibers were prepared from TOTAL™ 3860 polypropylene having a melt flow index of 70 from Total Petrochemicals, to which was added 0.75 wt. % of CHIMASSORB 944 hindered-amine light stabilizer from Ciba Specialty Chemicals. The extrusion head 10 had 16 rows of orifices, with 32 orifices in a row, making a total of 512 orifices. The orifices were arranged in a square pattern (meaning that orifices were in alignment transversely as well as longitudinally, and equally spaced both transversely and longitudinally) with 0.25 inch (6.4 mm) spacing. The polymer was fed to the extrusion head at different rates, noted below in Table 1A, where the polymer was heated to a temperature of 235° C. (455° F.). Two quenching air streams (18*b* in FIG. 2; stream 18*a* was not employed) were used. A first, upper quenching air stream was supplied from quench boxes 16 in. (406 mm) in height at an approximate face velocity of 83 ft/min (0.42 m/sec) for Run Nos. 1-1 through 1-3 and 93 ft/min (0.47 m/sec) for Run No. 1-4, at a temperature of 45° F. (7.2° C.). A second, lower quenching air stream was supplied from quench boxes 7.75 in. (197 mm) in height at an approximate face velocity of 31 ft/min (0.16 m/sec) for Run Nos. 1-1 through 1-3 and 43 ft/min (0.22 m/sec) for Run No. 1-4, at ambient room temperature. A movable-wall attenuator like that shown in U.S. Pat. No. 6,607,624 B2 (Berrigan et al.) was employed, using an air knife gap (30 in Berrigan et al.) of 0.030 in. (0.76 mm), air fed to the air knife at a pressure of 14 psig (0.1 MPa), an attenuator top gap width of 0.20 in. (5 mm), an attenuator bottom gap width of 0.185 in. (4.7 mm), and 6 in. (152 mm) long attenuator sides (36 in Berrigan et al.). The distance (17 in FIG. 2) from the extrusion head 10 to the attenuator 16 was 31 in. (78.7 cm), and the distance (524 plus 522 in FIG. 3) from the attenuator 16 to the collection belt 19 was 27 in. (68.6 cm). The meltspun fiber stream was deposited on the collection belt 19 at a width of about 14 in. (about 36 cm). Collection belt 19 was made from 20-mesh stainless steel and moved at a rate of 29 ft/min (about 8.8 meters/min) for Run Nos. 1-1 through 1-3 and 47 ft/min (about 14.3 meters/min) for Run No. 1-4. Based on similar samples, the meltspun fibers of Run Nos. 1-1 through 1-3 were estimated to have a median fiber diameter of approximately 11 μm. The meltspun fibers of Run No. 1-4 were measured with scanning electron microscopy (SEM) and found to have a median diameter (44 fibers measured) of 15 μm.

The meltblown fibers were prepared from TOTAL 3960 polypropylene having a melt flow index of 350 from Total Petrochemicals, to which was added 0.75 wt. % CHIMASSORB 944 hindered-amine light stabilizer. The polymer was fed into a drilled-orifice meltblowing die (504 in FIG. 2 and FIG. 3) having a 10-inch-wide (254 mm) nosetip, with twenty-five 0.015 in. diameter (0.38 mm) orifices per inch (one orifice per mm), at a rate of 10 pounds per hour (4.54 kg per hour). The die temperature was 325° C. (617° F.) and the primary air stream temperature was 393° C. (740° F.). The flow of air in the primary air stream was estimated to be about 250 scfm (7.1 standard $m^3$/min). The relationship of the meltblowing die to the spunbond fiber stream 1 was as follows: the distance 520 was 4 in. (about 10 cm); the distance 522 was 8.5 in. (about 22 cm); the distance 524 was 19 in. (about 48 cm); and the angle θ was 20°. The meltblown fiber stream was deposited on the collection belt 19 at a width of about 12 in. (about 30 cm). The meltblown fibers of Run No. 1-4 were measured with SEM and found to have a median diameter (270 fibers measured) of 1.13 μm. The meltblown fibers of Run Nos. 1-1 through 1-3 were assumed to have the same fiber sizes as the meltblown fibers of Run No. 1-4 since they all were produced using the same meltblowing process conditions.

The vacuum under collection belt 19 was estimated to be in the range of 6-12 in. $H_2O$ (1.5-3 kPa). The region 215 of the plate 211 had 0.062-inch-diameter (1.6 mm) openings in a staggered spacing resulting in 23% open area; the web hold-down region 216 had 0.062-inch-diameter (1.6 mm) openings in a staggered spacing resulting in 30% open area; and the heating/bonding region 217 and the quenching region 218 had 0.156-inch-diameter (4.0 mm) openings in a staggered spacing resulting in 63% open area. Air was supplied through the conduits 207 at a rate sufficient to present 500 $ft.^3$/min (about 14.2 $m^3$/min) of air at the slot 209, which was 1.5 in. by 22 in. (3.8 by 55.9 cm). The bottom of the plate 208 was ¾ to 1 in. (1.9-2.54 cm) from the collected web 20 on collector 19. The temperature of the air passing through the slot 209 (as measured by open junction thermocouples at the entrance of the conduits 207 to the housing 201) is given in Table 1A for each web.

Essentially 100% of the meltblown fibers were captured within the meltspun stream. The web of Run No. 1-4 was cross-sectioned and microfibers were found to be distributed through the full thickness of the web. At the polymer flow rates reported in Table 1A, the webs of Run Nos. 1-1 through 1-3 had a ratio of about 64 parts by weight of meltspun fibers to 36 parts by weight meltblown fibers, and the web of Run No. 1-4 had a ratio of about 82 parts by weight of meltspun fibers to 18 parts by weight meltblown fibers.

The web leaving the quenching area 220 was bonded with sufficient integrity to be handled by normal processes and equipment; the web could be wound by normal windup into a storage roll or could be subjected to various operations such as heating and compressing the web over a hemispherical mold to form a molded respirator. Upon microscopic examination the meltspun fibers were found to be bonded at fiber intersections and the meltblown fibers were found to be substantially unmelted and having limited bonding to the meltspun fibers (which could have developed at least in part during mixing of the meltspun and microfiber streams).

Other web and forming parameters are described below in Table 1A, where the abbreviations "QFH" and "BMF" respectively mean "quenched flow heater" and "meltblown microfibers".

TABLE 1A

| Run No. | Basis weight, gsm | QFH temp, ° C. | Meltspun rate, g/h/m | Meltspun rate, lb/hr | BMF rate, lb/in/hr | BMF rate, lb/hr | BMF % mass |
|---|---|---|---|---|---|---|---|
| 1-1F | 107 | 155 | 0.30 | 20.3 | 1.00 | 10.0 | 36% |
| 1-2F | 107 | 159 | 0.30 | 20.3 | 1.00 | 10.0 | 36% |
| 1-3F | 107 | 151 | 0.30 | 20.3 | 1.00 | 10.0 | 36% |
| 1-4F | 110 | 147 | 0.80 | 54.2 | 1.00 | 10.0 | 18% |

The four collected webs were hydrocharged with deionized water according to the technique taught in U.S. Pat. No. 5,496,507 (Angadjivand et al. '507) and allowed to dry by hanging on a line overnight at ambient conditions. The charged flat webs were evaluated using a DOP challenge aerosol as described above to determine the flat web properties shown below in Table 1B:

TABLE 1B

| Run No. | Basis Wt., gsm | EFD, μm | Thickness, mm | Pressure Drop, mm $H_2O$ | Initial Penetration, % DOP | Quality Factor, 1/mm $H_2O$ (DOP) |
|---|---|---|---|---|---|---|
| 1-1F | 107 | 8.0 | — | 13.66 | 0.48 | 0.39 |
| 1-2F | 107 | 8.0 | 1.05 | 11.52 | 1.73 | 0.35 |
| 1-3F | 107 | 8.0 | — | 14.42 | 0.36 | 0.39 |
| 1-4F | 110 | 11.3 | 1.14 | 5.00 | 4.34 | 0.63 |

The webs were next formed into smooth, cup-shaped molded respirators using a heated, hydraulic molding press and a 0.20 in. (5.1 mm) mold gap. The webs were molded with the collector side of the web (the side of the web that directly contacted the collector surface during web collection) both up and down, to examine whether fiber intermixing or the collection surface affected the loading behavior. The resulting cup-shaped molded matrices had an approximate external surface area of 145 $cm^2$ and good stiffness as evaluated manually. A molded respirator made from the Run No. 1-2F web was evaluated to determine its King Stiffness value, and found to have a King Stiffness of 0.68 N (0.152 lb). Based on similar samples and the data in Example 10 and FIG. 23 (discussed below), a modest basis weight increase of about 20 to 50 gsm should increase the molded matrix King Stiffness to more than 1 N.

The molded matrices were load tested using a NaCl challenge aerosol as described above to determine the initial pressure drop and initial % NaCl penetration, maximum pressure drop and maximum % NaCl penetration, milligrams of NaCl at maximum penetration (the total weight challenge to the filter up to the time of maximum penetration) and the Quality Factor QF. A commercial multilayer N95 respirator was tested for comparison purposes. The results are shown below in Table 1CB:

TABLE 1C

| Run No. | Flat Web of Run No. | Collector Side | Mold temp, ° C. | Mold Time, sec | Initial Pressure Drop, mm $H_2O$ at 85 liters/min | Initial NaCl Penetration, % | Maximum Pressure Drop, mm $H_2O$ at 85 liters/min | Maximum NaCl Penetration, % | Challenge Maximum NaCl Penetration, mg | Quality Factor, QF (NaCl) |
|---|---|---|---|---|---|---|---|---|---|---|
| 1-5M | 1-1F | Down | 135 | 5 | 9.4 | 0.034 | 34.3 | 0.25 | 75.2 | 0.85 |
| 1-6M | 1-1F | Up | 121 | 10 | 12.0 | 0.075 | 15.6 | 0.08 | 5.1 | 0.60 |
| 1-7M | 1-1F | Up | 121 | 5 | 11.9 | 0.094 | 17.5 | 0.12 | 7.3 | 0.59 |
| 1-8M | 1-1F | Up | 135 | 5 | 11.8 | 0.117 | 15.7 | 0.13 | 4.7 | 0.57 |
| 1-9M | 1-1F | Up | 135 | 5 | 10.8 | 0.097 | 13.8 | 0.10 | 4.8 | 0.64 |
| 1-10M | 1-2F | Down | 135 | 5 | 5.9 | 0.066 | 9.6 | 0.29 | 91.8 | 1.24 |
| 1-11M | 1-2F | Down | 135 | 5 | 7.9 | 0.295 | 13.9 | 1.06 | 25.7 | 0.74 |
| 1-12M | 1-2F | Down | 135 | 5 | 5.1 | 0.092 | 7.2 | 0.16 | 63.0 | 1.37 |
| 1-13M | 1-2F | Down | 135 | 5 | 8.4 | 0.150 | 15.5 | 0.62 | 26.8 | 0.77 |
| 1-14M | 1-2F | Up | 121 | 5 | 8.5 | 0.226 | 12.3 | 0.34 | 6.6 | 0.72 |
| 1-15M | 1-2F | Up | 121 | 5 | 9.2 | 0.305 | 13.8 | 0.44 | 6.6 | 0.63 |
| 1-16M | 1-2F | Up | 135 | 5 | 9.7 | 0.723 | 12.8 | 0.81 | 4.4 | 0.51 |
| 1-17M | 1-2F | Up | 135 | 5 | 9.1 | 0.515 | 12.8 | 0.55 | 6.6 | 0.58 |
| 1-18M | 1-3F | Down | 135 | 5 | 11.9 | 0.065 | 21.7 | 0.17 | 28.1 | 0.62 |
| 1-19M | 1-3F | Up | 121 | 10 | 13.8 | 0.048 | 16.2 | 0.06 | 2.9 | 0.55 |
| 1-20M | 1-3F | Up | 121 | 5 | 12.0 | 0.177 | 15.1 | 0.19 | 4.4 | 0.53 |
| 1-21M | 1-3F | Up | 135 | 5 | 15.1 | 0.113 | 15.1 | 0.11 | — | 0.45 |
| 1-22M | 1-3F | Up | 135 | 5 | 13.4 | 0.095 | 17.6 | 0.10 | 5.0 | 0.52 |
| 1-23M | 1-4F | Down | 135 | 5 | 4.2 | 0.520 | 9.0 | 4.45 | 41.9 | 1.25 |
| 1-24M | 1-4F | Up | 135 | 5 | 4.3 | 0.699 | 9.4 | 1.73 | 17.4 | 1.15 |
| 1-25 | Commercial Multilayer N95 respirator | | | | 6.3 | 0.104 | 8.5 | 0.43 | 167.5 | 0.86 |

As the results in Table 1C show, many of the samples start with pressure drop less than 10 mm $H_2O$ and experience maximum penetration <5%, and some of the samples start with pressure drop less than 10 mm $H_2O$ and experience maximum penetration <1%. It is also noted that some of the samples (e.g., Run Nos. 1-10M through 1-13M) are replicates of one another which exhibited moderate variability between replicates; the variability is believed to be due to variations in setting the mold gap during the respirator forming process. The most preferred embodiments in Table 1C are Run Nos. 1-10M, 1-12M and 1-23M. Run Nos. 1-10M and 1-12M exhibit penetration and pressure drop loading results very similar to the commercial respirator. Run No. 1-23M was made from a web formed at a significantly higher collector speed, has low initial pressure drop, and has maximum penetration less than 5%. Other preferred embodiments in Table 1C include Run Nos. 1-5M, 1-11M, 1-13M and 1-24M, because they exhibit initial pressure drop of less than 10 mm $H_2O$, maximum penetrations of less than 5%, and moderate NaCl challenge at maximum penetration (meaning that they do not plug up too rapidly).

EXAMPLE 2

Using a meltblowing die like that shown in FIG. 8 and procedures like those described in Wente, Van A. "superfine Thermoplastic Fiber", Industrial and Engineering Chemistry, vol. 48. No. 8, 1956, pp 1342-1346 and Naval Research Laboratory Report 111437, Apr. 15, 1954, four monocomponent monolayer meltblown webs were formed from TOTAL 3960 polypropylene to which had been added 1% tristearyl melamine as an electret charging additive. The polymer was fed to a Model 20 DAVIS STANDARD™ 2 in. (50.8 mm) single screw extruder from the Davis Standard Division of Crompton & Knowles Corp. The extruder had a 20/1 length/diameter ratio and a 3/1 compression ratio. A Zenith 10 cc/rev melt pump metered the flow of polymer to a 10 in. (25.4 cm) wide drilled orifice meltblowing die whose original 0.012 in. (0.3 mm) orifices had been modified by drilling out every 21st orifice to 0.025 in. (0.6 mm), thereby providing a 20:1 ratio of the number of smaller size to larger size holes and a 2:1 ratio of larger hole size to smaller hole size. The line of orifices had 25 holes/inch (10 holes/cm) hole spacing. Heated air attenuated the fibers at the die tip. The airknife employed a 0.010 in. (0.25 mm) positive set back and a 0.030 in. (0.76 mm) air gap. No to moderate vacuum was pulled through a medium mesh collector screen at the point of web formation. The polymer output rate from the extruder was varied from 1.0 to 4.0 lbs/in/hr (0.18 to 0.71 kg/cm/hr), the DCD (die-to-collector distance) was varied from 12.0 to 25.0 in. (30.5 to 63.5 cm) and the air pressure was adjusted as needed to provide webs with a basis weight and EFD as shown below in Table 1A. The webs were hydrocharged with distilled water according to the technique taught in U.S. Pat. No. 5,496,507 (Angadjivand et al. '507) and allowed to dry. Set out below in Table 2A are the Run Number, basis weight, EFD, web thickness, initial pressure drop, initial NaCl penetration and Quality Factor QF for each web at a 13.8 cm/sec face velocity.

TABLE 2A

| Run No. | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|
| 2-1F | 240 | 14.6 | 3.3 | 6.10 | 0.368 | 0.92 |
| 2-2F | 243 | 18 | 2.54 | 4.43 | 1.383 | 0.97 |
| 2-3F | 195 | 18.4 | 2.16 | 3.93 | 1.550 | 1.06 |
| 2-4F | 198 | 14.6 | 2.74 | 5.27 | 0.582 | 0.98 |

The Table 2A webs were next molded to form cup-shaped molded matrices for use as personal respirators. The top mold was heated to about 235° F. (113° C.), the bottom mold was heated to about 240° F. (116° C.), a mold gap of 0.050 in. (1.27 mm) was employed and the web was left in the mold for about 9 seconds. Upon removal from the mold, the matrix retained its molded shape. Set out below in Table 2B are the Run Number, King Stiffness, initial pressure drop, and the initial (and for Run Nos. 2-1M and 2-4M, the maximum loading) NaCl penetration values for the molded matrices.

TABLE 2B

| Run No. | King Stiffness, N | Pressure Drop, mm $H_2O$ | Initial Penetration, % | Maximum Loading Penetration, % |
|---|---|---|---|---|
| 2-1M | 1.87 | 7.37 | 0.269 | 2.35 |
| 2-2M | 2.89 | 4.97 | 0.541 | — |
| 2-3M | 2.00 | 3.93 | 0.817 | — |
| 2-4M | 1.60 | 5.77 | 0.348 | 3.95 |

Figure 12:
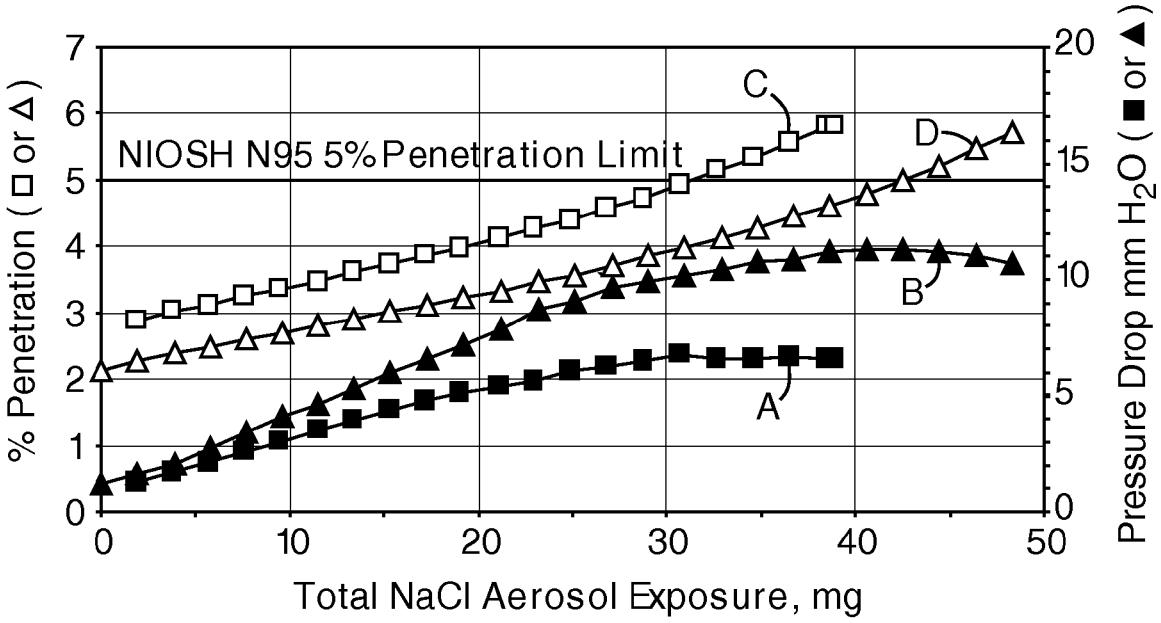
FIG. 12 is a graph showing % NaCl penetration and pressure drop for the molded matrices of Run Nos. 2-1M and 2-4M.

FIG. 12 is a graph showing % NaCl penetration and pressure drop for the molded matrices of Run Nos. 2-1M and 2-4M. Curves A and B respectively are the % NaCl penetration results for Run Nos. 2-1M and 2-4M, and Curves C and D respectively are the pressure drop results for Run Nos. 2-1M and 2-4M. FIG. 12 shows that the molded matrices of Run Nos. 2-1M and 2-4M provide monocomponent, monolayer molded matrices which pass the N95 NaCl loading test of 42 C.F.R. Part 84.

EXAMPLE 3

Using the general method of Example 2, webs were made from 100% TOTAL 3960 polypropylene and then 1) corona charged or 2) corona and hydrocharged with distilled water. Set out below in Table 3A are the Run Number, charging technique, basis weight, EFD, web thickness, initial pressure drop, initial NaCl penetration and Quality Factor QF for each web.

TABLE 3A

| Run No. | Charging Technique | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|---|
| 3-1F | Corona | 237 | 14.2 | 3.23 | 6.70 | 32.4 | 0.17 |
| 3-2F | Corona/ Hydrocharged | 237 | 14.2 | 3.23 | 6.77 | 13.2 | 0.30 |
| 3-3F | Corona | 197 | 13.3 | 2.82 | 5.73 | 28.7 | 0.22 |
| 3-4F | Corona/ Hydrocharged | 197 | 13.3 | 2.82 | 5.93 | 6.3 | 0.47 |

The Table 3A webs were next molded using the method of Example 2 to form cup-shaped molded matrices for use as personal respirators. Set out below in Table 3B are the Run Number, King Stiffness, initial pressure drop, and initial NaCl penetration for the molded matrices.

TABLE 3B

| Run No. | King Stiffness, N | Pressure Drop, mm $H_2O$ | Initial Penetration, % |
|---|---|---|---|
| 3-1M | 1.82 | 8.37 | 16.867 |
| 3-2M | 1.82 | 10.27 | 7.143 |
| 3-3M | 1.65 | 6.47 | 16.833 |
| 3-4M | 1.65 | 7.47 | 5.637 |

The data in Table 3B show that these molded matrices had greater penetration than the Example 2 molded matrices but that they also had appreciable King Stiffness.

EXAMPLE 4

Using the method of Example 2, webs were made from TOTAL 3960 polypropylene to which had been added 0.8% CHIMASSORB 944 hindered amine light stabilizer from Ciba Specialty Chemicals as an electret charging additive and then hydrocharged with distilled water. Set out below in Table 4A are the Run Number, basis weight, EFD, web thickness, initial pressure drop, initial NaCl penetration and Quality Factor QF for each web.

TABLE 4A

| Run No. | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|
| 4-1F | 246 | 17.9 | 2.95 | 4.27 | 0.811 | 1.13 |
| 4-2F | 203 | 18 | 2.41 | 3.37 | 2.090 | 1.15 |

The Table 4A webs were next molded using the method of Example 2 to form cup-shaped molded matrices for use as personal respirators. Set out below in Table 4B are the Run Number, King Stiffness, initial pressure drop, and initial NaCl penetration for the molded matrices.

TABLE 4B

| Run No. | King Stiffness, N | Pressure Drop, mm $H_2O$ | Initial Penetration, % |
|---|---|---|---|
| 4-1M | 2.89 | 5.30 | 0.591 |
| 4-2M | 1.96 | 3.90 | 1.064 |

The data in Table 4B show that these molded matrices had greater penetration than the Example 2 molded matrices but that they also had appreciable King Stiffness.

EXAMPLE 5

Using the method of Example 4, webs were made from TOTAL 3868 polypropylene having a melt flow index of 37 from Total Petrochemicals to which had been added 0.8% CHIMASSORB 944 hindered amine light stabilizer from Ciba Specialty Chemicals as an electret charging additive and then hydrocharged with distilled water. Set out below in Table 5A are the Run Number, basis weight, EFD, web thickness, initial pressure drop, initial NaCl penetration and Quality Factor QF for each web.

TABLE 5A

| Run No. | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|
| 5-1F | 243 | 22.2 | 2.67 | 3.13 | 4.040 | 1.02 |
| 5-2F | 196 | 18.9 | 2.46 | 2.73 | 4.987 | 1.10 |

The Table 5A webs were next molded using the method of Example 2 to form cup-shaped molded matrices for use as personal respirators. Set out below in Table 5B are the Run Number, King Stiffness, initial pressure drop, and initial NaCl penetration for the molded matrices.

TABLE 5B

| Run No. | King Stiffness, N | Pressure Drop, mm $H_2O$ | Initial Penetration, % |
|---|---|---|---|
| 5-1M | 2.14 | 4.87 | 0.924 |
| 5-2M | 1.78 | 3.43 | 1.880 |

The data in Table 5B show that these molded matrices had greater penetration than the Example 2 molded matrices but that they also had appreciable King Stiffness.

EXAMPLE 6

Using the method of Example 3, webs were made from EXXON™ PP3746G 1475 melt flow rate polypropylene available from Exxon Mobil Corporation and then 1) corona charged or 2) corona and hydrocharged with distilled water. Set out below in Table 6A are the Run Number, charging technique, basis weight, EFD, web thickness, initial pressure drop, initial NaCl penetration and Quality Factor QF for each web.

TABLE 6A

| Run No. | Charging Technique | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|---|
| 6-1F | Corona | 247 | 14.7 | 4.22 | 10.63 | 17.533 | 0.16 |
| 6-2F | Corona/ Hydrocharged | 247 | 14.7 | 4.22 | 14.6 | 7.55 | 0.18 |
| 6-3F | Corona | 241 | 17.9 | 3.02 | 6.3 | 23.533 | 0.24 |
| 6-4F | Corona Hydrocharged | 241 | 17.9 | 3.02 | 7.53 | 6.52 | 0.36 |
| 6-5F | Corona | 200 | 14 | 3.10 | 7.87 | 12.667 | 0.26 |
| 6-6F | Corona/ Hydrocharged | 200 | 14 | 3.10 | 10.43 | 7.06 | 0.25 |
| 6-7F | Corona | 203 | 18.3 | 2.45 | 4.27 | 17.333 | 0.41 |
| 6-8F | Corona/ Hydrocharged | 203 | 18.3 | 2.45 | 5.2 | 6.347 | 0.53 |

The Table 6A webs were next molded using the method of Example 2 to form cup-shaped molded matrices for use as personal respirators. Set out below in Table 6B are the Run Number, King Stiffness, initial pressure drop, and initial NaCl penetration for the molded matrices.

TABLE 6B

| Run No. | King Stiffness, N | Pressure Drop, mm $H_2O$ | Initial Penetration, % |
|---|---|---|---|
| 6-1M | 2.05 | 10.63 | 17.533 |
| 6-2M | 2.05 | 14.60 | 7.550 |
| 6-3M | 2.85 | 6.30 | 23.533 |
| 6-4M | 2.85 | 7.53 | 6.520 |
| 6-5M | 1.51 | 7.87 | 12.667 |
| 6-6M | 1.51 | 10.43 | 7.060 |
| 6-7M | 2.05 | 4.27 | 17.333 |
| 6-8M | 2.05 | 5.20 | 6.347 |

Figure 13:
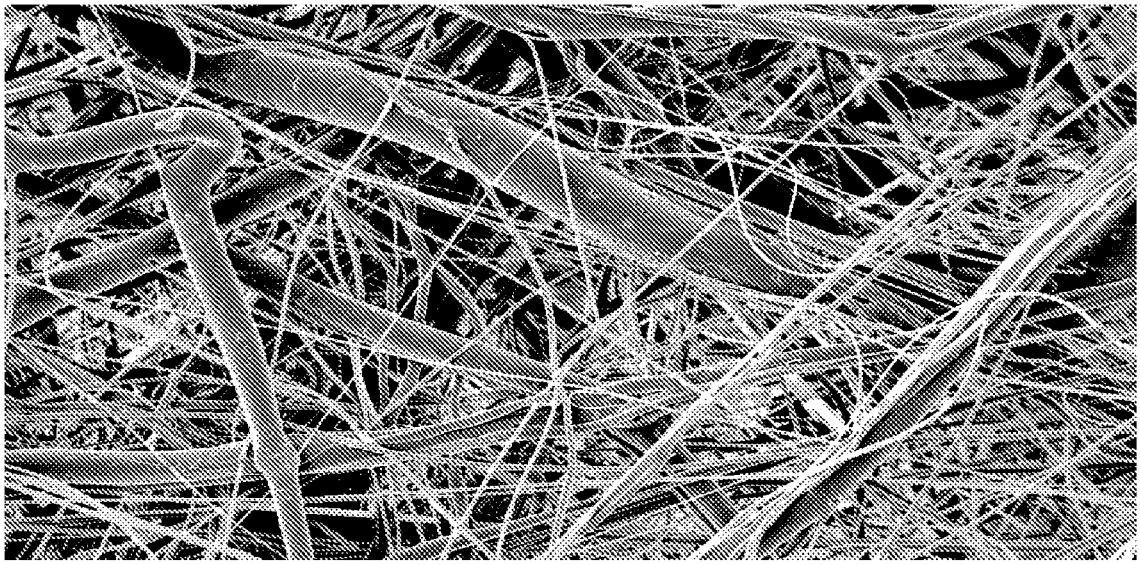
FIG. 13 and FIG. 14 are photomicrographs of the Run No. 6-8F flat web and the Run No. 6-8M molded matrix.
Figure 14:
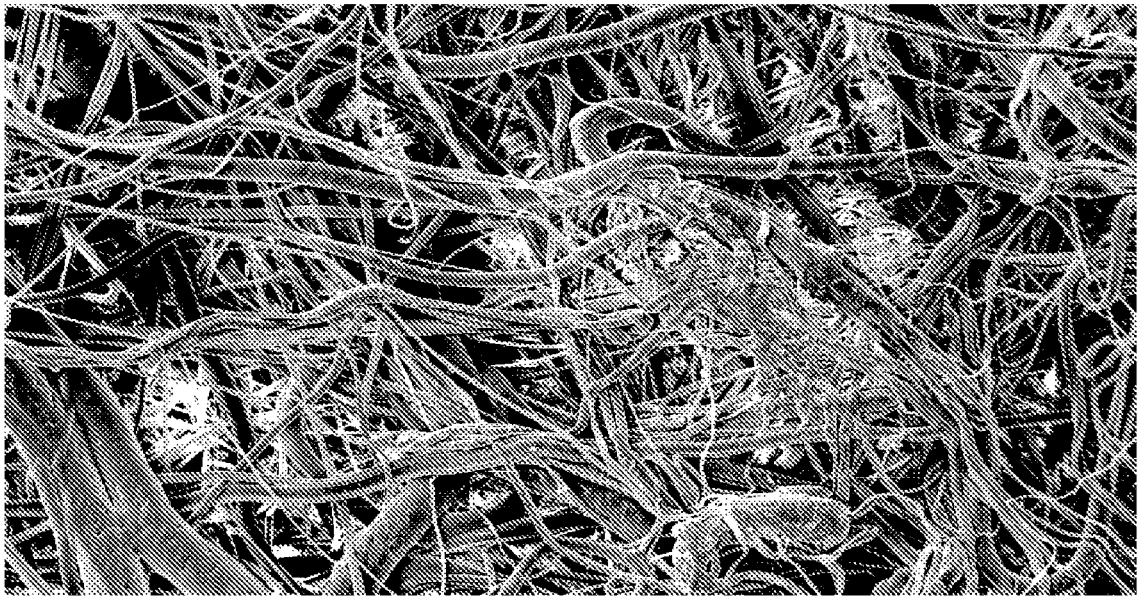
Figure 15:
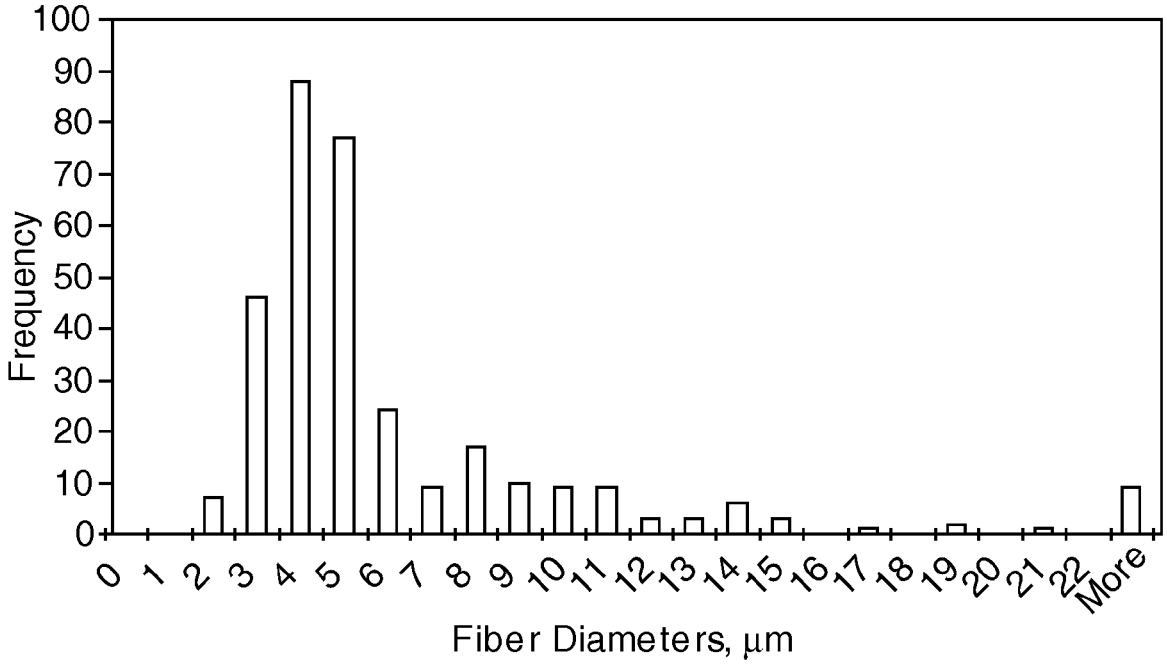
FIG. 15 and FIG. 16 are histograms of fiber count (frequency) vs. fiber size in μm for the Run No. 6-8F flat web and the Run No. 6-8M molded matrix.
Figure 16:
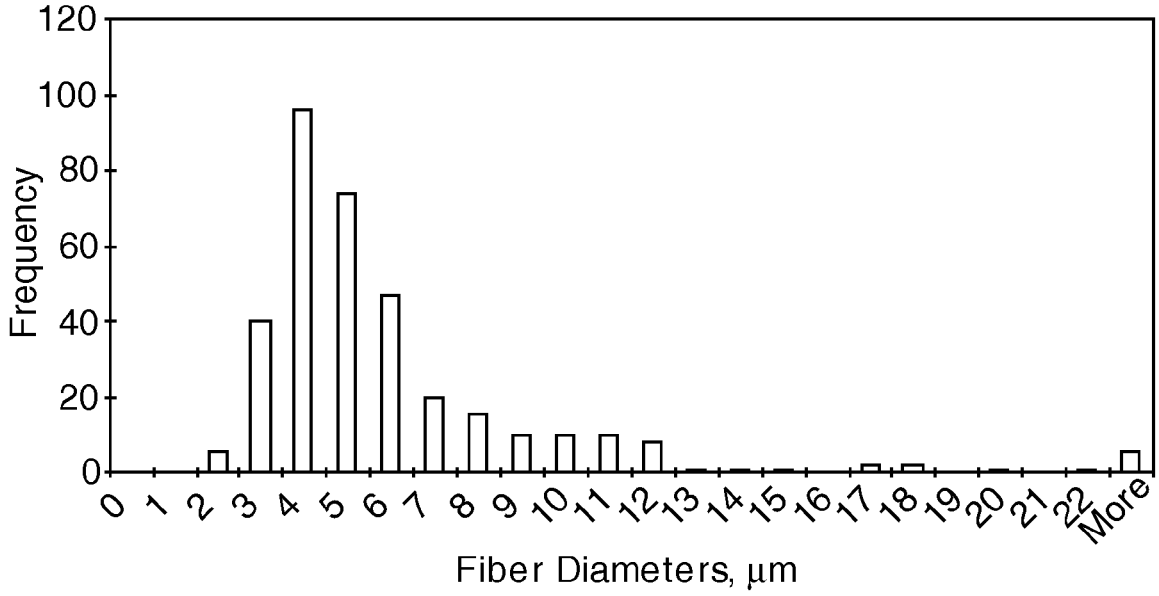

The Run No. 6-8F flat web and 6-8M molded matrix were analyzed using scanning electron microscopy (SEM), at magnifications of 50 to 1,000× made using a LEO VP 1450 electron microscope (from the Carl Zeiss Electron Microscopy Group), operated at 15 kV, 15 mm WD, 0° tilt, and using a gold/palladium-coated sample under high vacuum. FIG. 13 and FIG. 14 are photomicrographs of the Run No. 6-8F flat web and the Run No. 6-8M molded matrix. Histograms of fiber count (frequency) vs. fiber size in μm were obtained from SEM images at magnifications of 350 to 1,000× taken from each side of the flat web or matrix. About 150-200 fibers from the SEM image for each side were counted and measured using the UTHSCSA IMAGE TOOL image analysis program from the University of Texas Health Science Center at San Antonio, and then the observations for the two sides were combined. FIG. 15 and FIG. 16 are histograms of fiber count (frequency) vs. fiber size in μm for the Run No. 6-8F flat web and the Run No. 6-8M molded matrix. Further details regarding the fiber size analyses for these webs are shown below in Table 6C:

TABLE 6C

| (Values in μm): | 6-8F Flat Web | 6-8M Molded Matrix |
|---|---|---|
| Mean | 5.93 | 5.67 |
| Std. Dev. | 5.36 | 4.30 |
| Min. | 1.39 | 1.35 |
| Max. | 42.62 | 36.83 |
| Median | 4.24 | 4.44 |
| Mode | 4.06 | 3.94 |
| Fiber Count | 324 | 352 |

EXAMPLE 7

Using the method of Example 2, webs were made from EXXON PP3746G polypropylene to which had been added 1% tristearyl melamine as an electret charging additive and then hydrocharged with distilled water. Set out below in Table 7A are the Run Number, basis weight, EFD, web thickness, initial pressure drop, initial NaCl penetration and Quality Factor QF for each web.

TABLE 7A

| Run No. | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|
| 7-1F | 247 | 14.2 | 3.63 | 6.20 | 0.537 | 0.84 |
| 7-2F | 204 | 14.3 | 3.05 | 5.77 | 0.596 | 0.89 |

The Table 7A webs were next molded using the method of Example 2 to form cup-shaped molded matrices for use as personal respirators. Set out below in Table 7B are the Run Number, King Stiffness, initial pressure drop, and initial NaCl penetration for the molded matrices.

TABLE 7B

| Run No. | King Stiffness, N | Pressure Drop, mm $H_2O$ | Initial Penetration, % | Maximum Loading Penetration, % |
|---|---|---|---|---|
| 7-1M | 1.91 | 12.07 | 0.282 | 2.39 |
| 7-2M | 1.33 | 9.17 | 0.424 | 5.14 |

Figure 17:
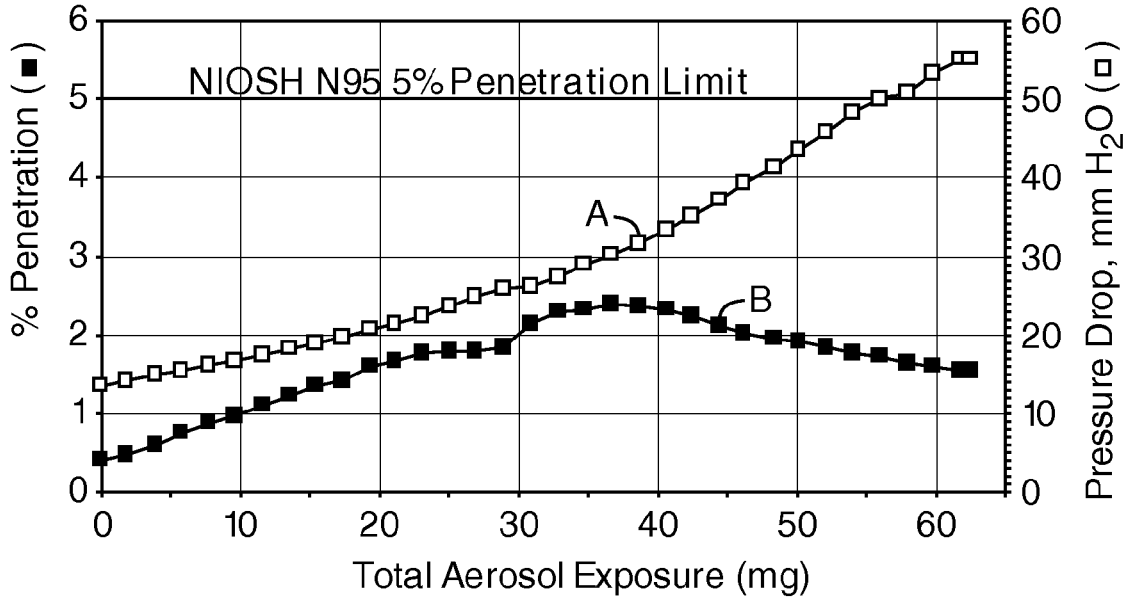
FIG. 17 is a graph showing % NaCl penetration and pressure drop for the molded matrix of Run No. 7-1M.

FIG. 17 is a graph showing % NaCl penetration and pressure drop for the molded matrix of Run No. 7-1M. Curves A and B respectively are the % NaCl penetration and pressure drop results. FIG. 17 and the data in Table 7B show that the molded matrix of Run No. 7-1M provides a monocomponent, monolayer molded matrix which passes the N95 NaCl loading test of 42 C.F.R. Part 84.

EXAMPLE 8

Using the method of Example 4, webs were made from EXXON PP3746G polypropylene to which had been added 0.8% CHIMASSORB 944 hindered amine light stabilizer from Ciba Specialty Chemicals as an electret charging additive and then hydrocharged with distilled water. Set out below in Table 8A are the Run Number, basis weight, EFD, web thickness, initial pressure drop, initial NaCl penetration and Quality Factor QF for each web.

TABLE 8A

| Run No. | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|
| 8-1F | 244 | 14.4 | 3.86 | 6.50 | 0.129 | 1.02 |
| 8-2F | 239 | 18.5 | 3.02 | 4.20 | 0.883 | 1.13 |
| 8-3F | 204 | 14.6 | 3.10 | 5.67 | 0.208 | 1.09 |
| 8-4F | 201 | 18.7 | 2.46 | 3.43 | 1.427 | 1.24 |

The Table 8A webs were next molded using the method of Example 2 to form cup-shaped molded matrices for use as personal respirators. Set out below in Table 8B are the Run Number, King Stiffness, initial pressure drop, and the initial (and, for Run No. 8-3M, the maximum loading) NaCl penetration values for the molded matrices.

TABLE 8B

| Run No. | King Stiffness, N | Pressure Drop, mm $H_2O$ | Initial Penetration, % | Maximum Loading Penetration, % |
|---|---|---|---|---|
| 8-1M | 2.49 | 12.07 | 0.057 | |
| 8-2M | 2.89 | 6.87 | 0.485 | |
| 8-3M | 1.65 | 8.83 | 0.153 | 4.89 |
| 8-4M | 1.87 | 4.73 | 0.847 | |

The data in Table 8B show that at least the molded matrix of Run No. 8-3M provides a monocomponent, monolayer molded matrix which passes the N95 NaCl loading test of 42 C.F.R. Part 84. The Run No. 8-1M, 8-2M and 8-4M molded matrices were not tested to determine their maximum loading penetration.

EXAMPLE 9

Using the method of Example 3, webs were made from EXXON PP3746G polypropylene to which had been added 1% tristearyl melamine as an electret charging additive and then hydrocharged with distilled water. The resulting flat webs were formed into molded respirators whose other layers were like those in U.S. Pat. No. 6,041,782 (Angadjivand et al. '782) and U.S. Pat. No. 6,923,182 B2 (Angadjivand et al. '183). The respirators included a blown microfiber outer cover layer web, a PE85-12 thermoplastic nonwoven adhesive web from Bostik Findley, the flat web of this Example 9, another PE85-12 thermoplastic nonwoven adhesive web and another blown microfiber inner cover layer web. The layers were formed into a cup-shaped respirator using a mold like that described above but having a ribbed front surface. The resulting molded respirators were evaluated according to ASTM F-1862-05, "Standard Test Method for Resistance of Medical Face Masks to Penetration by Synthetic Blood (Horizontal Projection of Fixed Volume at a Known Velocity)", at test pressures of 120 mm Hg and 160 mm Hg. The 120 mm Hg test employed a 0.640 sec. valve time and a 0.043 MPa tank pressure. The 160 mm Hg test employed a 0.554 sec. valve time and a 0.052 MPa tank pressure. The respirators passed the test at both test pressures. Set out below in Table 9 are the Run Number, and the basis weight, EFD, thickness, initial pressure drop and initial NaCl penetration for the molded monocomponent web.

TABLE 9

| Run No. | Basis Wt., gsm | EFD, μm | Flat Web Thickness, mm | Pressure Drop, mm $H_2O$ after molding | Initial Penetration, % |
|---|---|---|---|---|---|
| 9-1M | 199 | 11.9 | 3.22 | 8.7 | 0.269 |
| 9-2M | 148 | 12.2 | 2.4 | 9.6 | 0.75 |

EXAMPLE 10

Using the method of Comparative Example 3 of U.S. Pat. No. 6,319,865 B1 (Mikami), webs were prepared using a 10 in. (25.4 cm) wide drilled orifice die whose tip had been modified to provide a row of larger and smaller sized orifices. The larger orifices had a 0.6 mm diameter (Da), the smaller orifices had a 0.4 mm diameter (Db), the orifice diameter ratio R (Da/Db) was 1.5, there were 5 smaller orifices between each pair of larger orifices and the orifices were spaced at 30 orifices/in. (11.8 A single screw extruder with a 50 mm diameter screw and a 10 cc melt pump were used to supply the die with 100% TOTAL 3868 polypropylene. The die also had a 0.20 mm air slit width, a 60° nozzle edge angle, and a 0.58 mm air lip opening. A fine mesh screen moving at 1 to 50 m/min was employed to collect the fibers. The other operating parameters are shown below in Table 10A:

TABLE 10A

| Parameter | Value |
|---|---|
| Polymer melt flow rate | 37 MFR |
| Extruder barrel temp | 320° C. |
| Screw speed | 8 rpm |
| Polymer flow rate | 4.55 kg/hr |
| Die temp | 300° C. |
| DCD | 200 mm |
| Die Air temp | 275° C. |
| Die Air rate | 5 $Nm^3$/min |
| Larger Orifice diameter Da | 0.6 mm |
| Smaller Orifice diameter Db | 0.4 mm |
| Orifice Diameter ratio R (Da/Db) | 1.5 |
| Number of smaller orifices per larger orifice | 5 |
| Average Fiber Diameter, μm | 2.44 |
| St Dev Fiber Diameter, μm | 1.59 |
| Min Fiber Diameter, μm | 0.65 |
| Max Fiber Diameter, μm | 10.16 |
| EFD, μm | 9.4 |
| Shot | Many |

Using the above-mentioned operating parameters, a shot-free web was not obtained. Had shot-free web been formed, the observed Effective Fiber Diameter value would likely have been less than the 9.4 μm value reported above. Shot-containing webs were nonetheless prepared at four different basis weights, namely; 60, 100, 150 and 200 gsm, by varying the collector speed.

Figure 18:
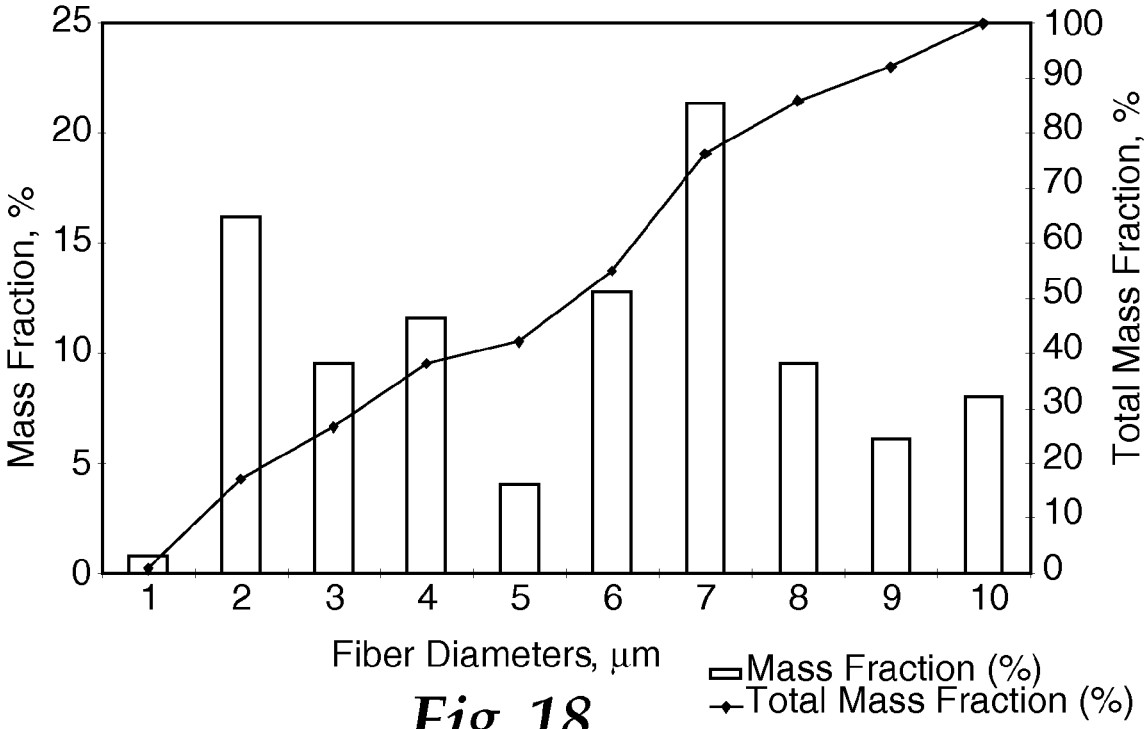
FIG. 18, FIG. 19 and FIG. 21 are histograms of mass fraction vs. fiber size in μm.

FIG. 18 is a histogram of mass fraction vs. fiber size in μm for the 200 gsm web. The web exhibited modes at 2 and 7 μm. Local peaks also appeared at 4 and 10 μm. The 4 μm peak did not have a larger height than fiber sizes 2 μm smaller and 2 μm larger and did not represent a mode, and the 10 μm peak did not have a larger height than fiber sizes 2 μm smaller and did not represent a mode. As shown in FIG. 18, the web did not have a larger size fiber mode greater than 10 μm.

The 200 gsm web was molded using the general method of Example 2 to form a cup-shaped molded matrix. The heated mold was closed to a 0.5 mm gap and an approximate 6 second dwell time was employed. The molded matrix was allowed to cool, and found to have a King Stiffness value of 0.64 N.

It was determined that shot could be reduced by employing a higher melt flow index polymer and increasing the DCD value. Using 100% TOTAL 3860X 100 melt flow rate polypropylene available from Total Petrochemicals and the operating parameters shown below in Table 10B, webs with substantially reduced shot were formed at 60, 100, 150 and 200 gsm by varying the collector speed. The resulting webs had considerably more fibers with a diameter greater than 10 μm than was the case for the webs produced using the Table 10A operating parameters.

TABLE 10B

| Parameter | Value |
|---|---|
| Polymer melt flow rate | 100 MFR |
| Extruder barrel temp | 320° C. |
| Screw speed | 8 rpm |
| Polymer flow rate | 4.55 kg/hr |
| Die temp | 290° C. |
| DCD | 305 mm |
| Die Air temp | 270° C. |
| Die Air rate | 4.4 $Nm^3$/min |
| Larger Orifice diameter Da | 0.6 mm |
| Smaller Orifice diameter Db | 0.4 mm |
| Orifice Diameter ratio R (Da/Db) | 1.5 |
| Number of smaller orifices per larger orifice | 5 |
| Average Fiber Diameter, μm | 3.82 |
| St Dev Fiber Diameter, μm | 2.57 |
| Min Fiber Diameter, μm | 1.33 |
| Max Fiber Diameter, μm | 20.32 |
| EFD, μm | 13.0 |
| Shot | Not Many |

Figure 19:
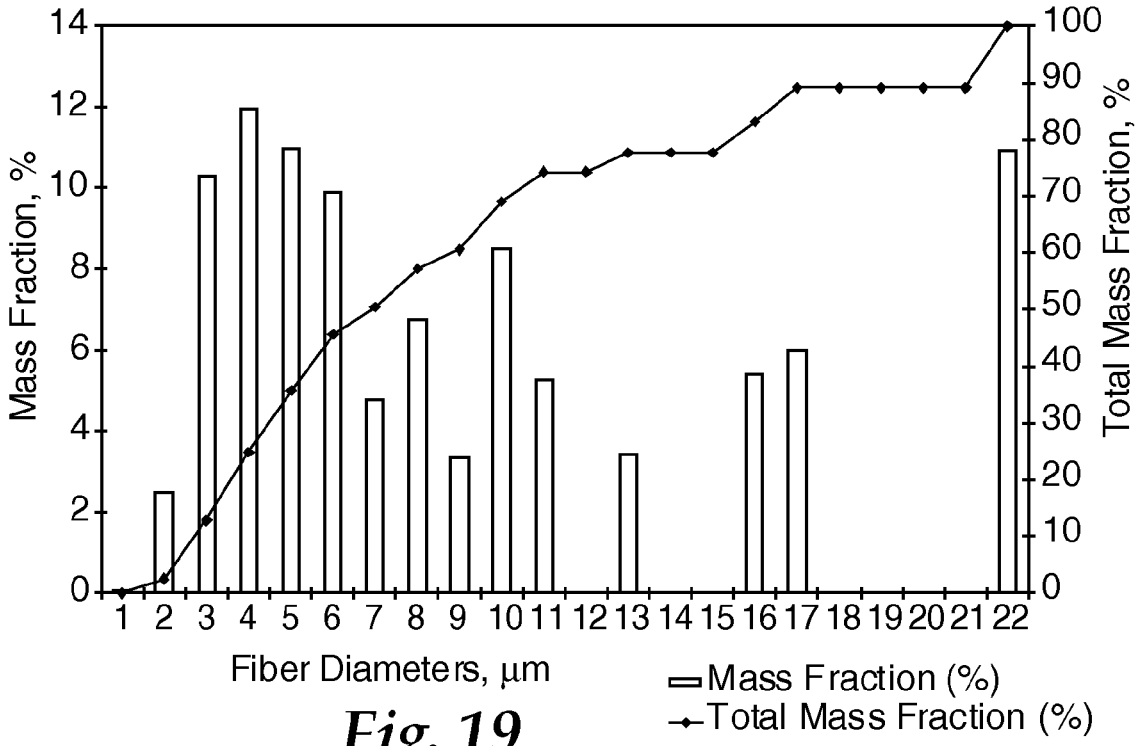
Figure 20:
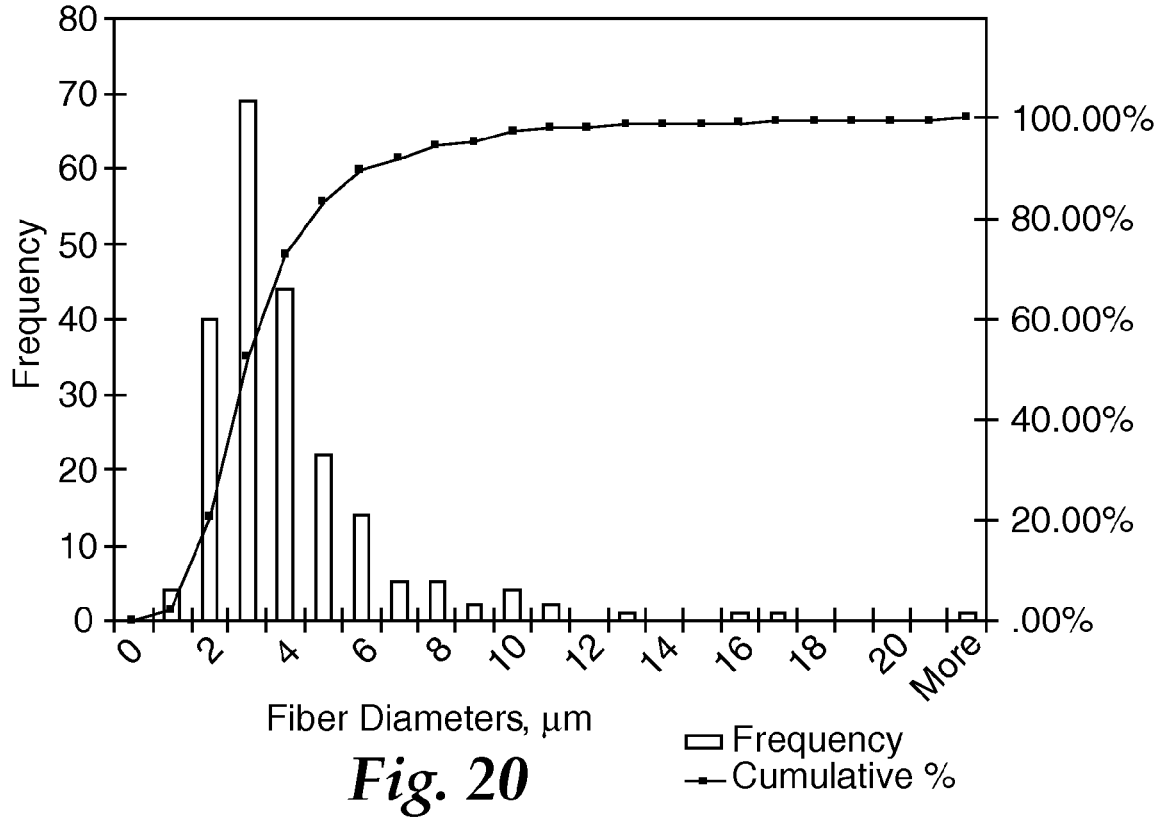
FIG. 20 and FIG. 22 are histograms of fiber count (frequency) vs. fiber size in μm, for a series of webs of Example 10.

FIG. 19 is a histogram of mass fraction vs. fiber size in μm for the 200 gsm web. The web exhibited modes at 4, 10, 17 and 22 μm. Local, non-modal peaks also appeared at 8 and 13 μm. As shown in FIG. 19, the web had larger size fiber modes greater than 10 μm. FIG. 20 is a histogram of fiber count (frequency) vs. fiber size in μm for the same 200 gsm web.

The 200 gsm web was molded using the general method of Example 2 to form a cup-shaped molded matrix. The heated mold was closed to a 0.5 mm gap and an approximate 6 second dwell time was employed. The molded matrix was allowed to cool, and found to have a King Stiffness value of 0.98 N.

It was also determined that shot could be reduced by employing a die with a greater number of smaller orifices per larger orifice than the Mikami et al. dies. Webs with minimal shot were also produced at 60, 100, 150 and 200 gsm using both TOTAL 3868 and TOTAL 3860X polymers and a different 10 in. (25.4 cm) wide drilled orifice die. The die tip for this latter die had been modified to provide a row of larger and smaller sized orifices with a greater number of smaller orifices between larger orifices than disclosed in Mikami et al. The larger orifices had a 0.63 mm diameter (Da), the smaller orifices had a 0.3 mm diameter (Db), the orifice diameter ratio R (Da/Db) was 2.1, there were 9 smaller orifices between each pair of larger orifices and the orifices were spaced at 25 orifices/in. (9.8 orifices/cm). A single screw extruder with a 50 mm diameter screw and a 10 cc melt pump were used to supply the die with polymer. The die also had a 0.76 mm air slit width, a 60° nozzle edge angle, and a 0.86 mm air lip opening. A fine mesh screen moving at 1 to 50 m/min and the operating parameters shown below in Table 10C were employed to collect webs at 60, 100, 150 and 200 gsm:

TABLE 10C

| Parameter | Value | |
|---|---|---|
| Polymer melt flow rate | 37 MFR | 100 MFR |
| Extruder barrel temp | 320° C. | 320° C. |
| Screw speed | 9 rpm | 10 rpm |
| Polymer flow rate | 4.8 kg/hr | 4.8 kg/hr |
| Die temp | 295° C. | 290° C. |
| DCD | 395 mm | 420 mm |
| Die Air temp | 278° C. | 274° C. |
| Die Air rate | 4.8 $Nm^3$/min | 4.8 $Nm^3$/min |
| Larger Orifice diameter Da | 0.63 mm | 0.63 mm |
| Smaller Orifice diameter Db | 0.3 mm | 0.3 mm |
| Orifice Diameter ratio R (Da/Db) | 2.1 | 2.1 |
| Number of smaller orifices per larger orifice | 9 | 9 |
| Average Fiber Diameter, μm | 2.31 | 2.11 |
| St Dev Fiber Diameter, μm | 4.05 | 3.12 |
| Min Fiber Diameter, μm | 0.17 | 0.25 |
| Max Fiber Diameter, μm | 23.28 | 23.99 |
| EFD, μm | 10.4 | 11.2 |
| Shot | Not Many | Not Many |

Figure 21:
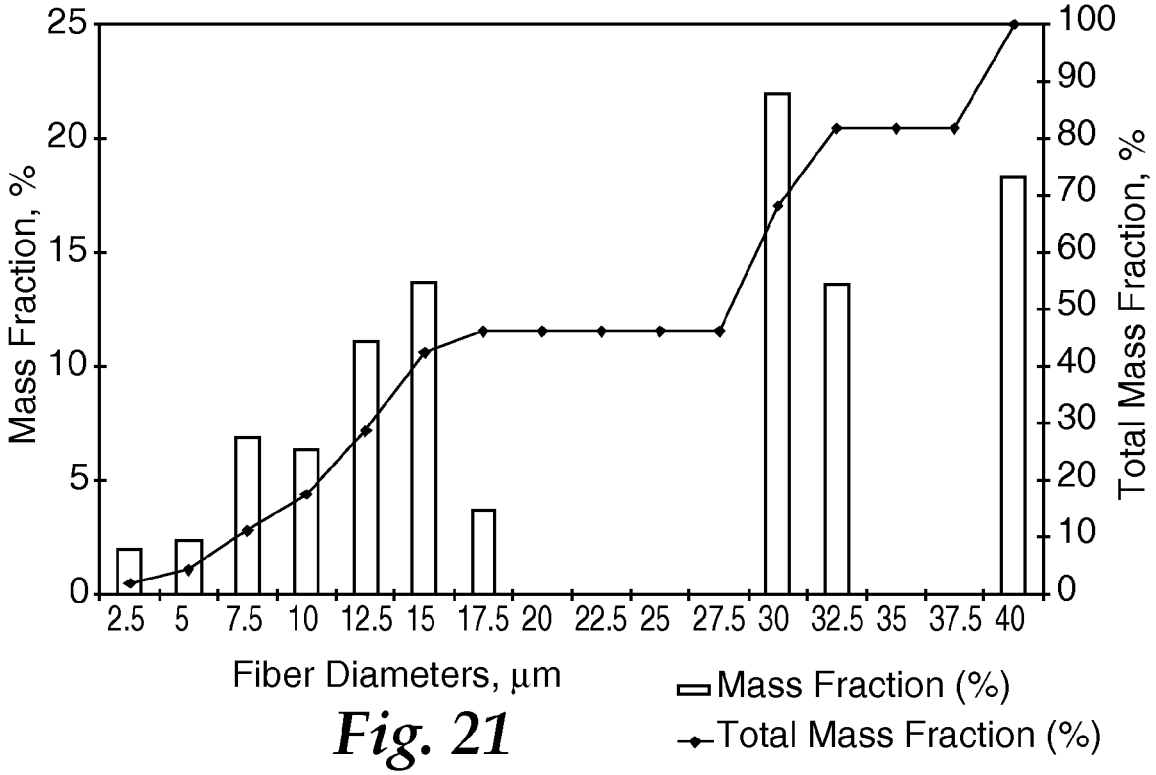
Figure 22:
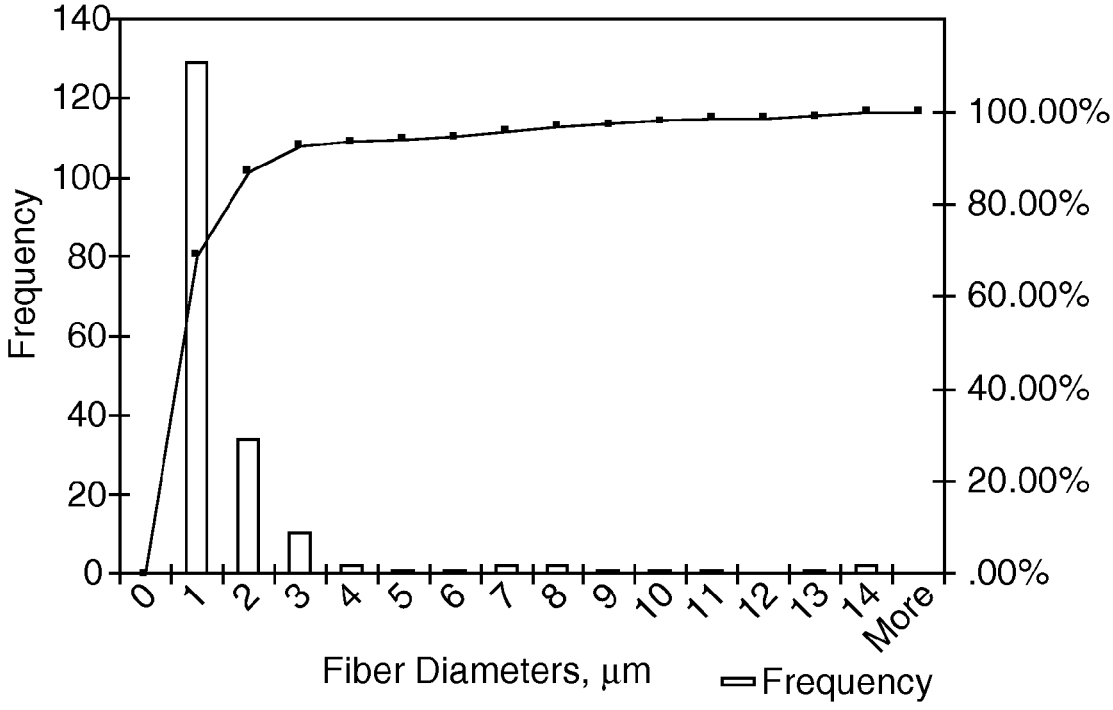

FIG. 21 is a histogram of mass fraction vs. fiber size in μm for the 200 gsm 100 MFR web. The web exhibited modes at 15, 30 and 40 μm. As shown in FIG. 21, the web had a larger size fiber mode greater than 10 μm. FIG. 22 is a histogram of fiber count (frequency) vs. fiber size in μm for the same 200 gsm web.

The webs from Table 10A, Table 10B and Table 10C were molded using the general method of Example 2 to form cup-shaped molded matrices. The heated mold was closed to a zero gap for webs with basis weights of 60 and 100 gsm, and closed to a 0.5 mm gap for webs with basis weights of 150 and 200 gsm. An approximate 6 second dwell time was employed. The 200 gsm molded matrices were evaluated to determine King Stiffness, and found to have respective King Stiffness values of 1.2 N (37 MFR polymer) and 1.6 N (100 MFR polymer). The 60, 100 and 150 gsm webs were below the threshold of measurement and thus were not evaluated to determine King Stiffness.

The molded matrices from all webs were also evaluated to determine their Deformation Resistance DR. The results are shown below in Table 10D:

TABLE 10D

| Web made according to operating parameters of: | Polymer Melt Flow Rate | Basis Weight, gsm 60 | 100 | 150 | 200 |
|---|---|---|---|---|---|
| | | Deformation Resistance DR, g | | | |
| Table 10A | 37 | 7.35 | 23.56 | 46.37 | 75.81 |
| Table 10B | 100 | 7.35 | 23.59 | 71.78 | 108.01 |
| Table 10C | 37 | 20.16 | 46.21 | 92.58 | 134.67 |
| Table 10C | 100 | 12.8 | 34.58 | 121.01 | 187.56 |

Figure 23:
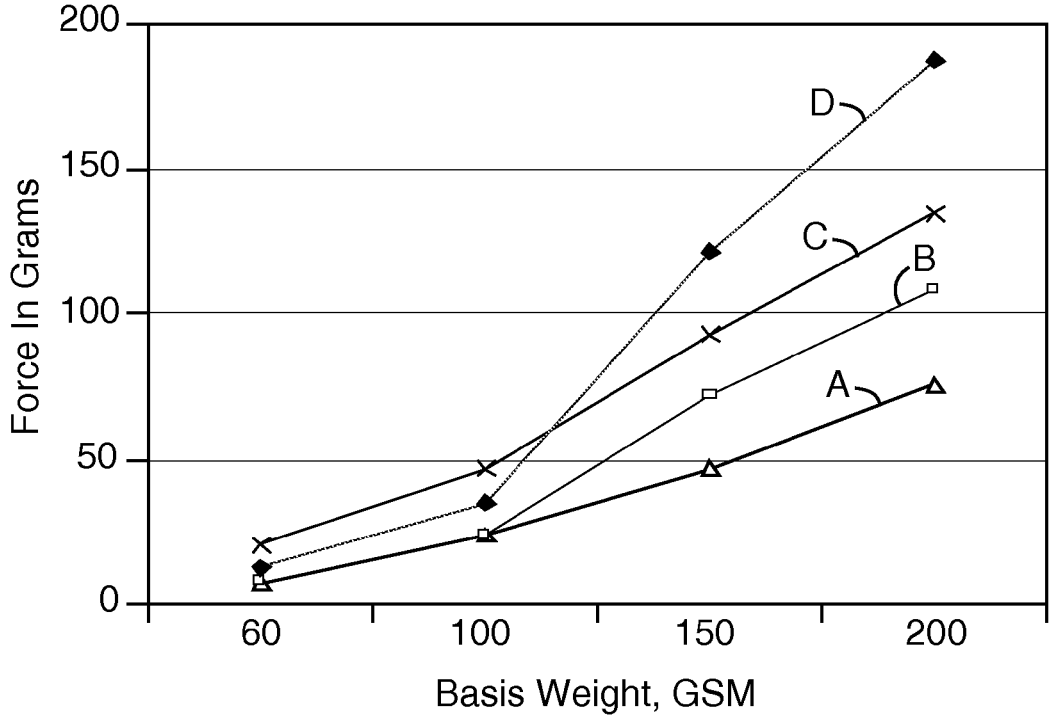
FIG. 23 is a plot of Deformation Resistance DR values vs. basis weight for several webs of Example 10.

FIG. 23 shows a plot of Deformation Resistance DR values vs. basis weight. Curves A, B, C and D respectively show webs made according to Table 10A (37 gsm, 5:1 Db/Da ratio), Table 10B and Table 10C (37 gsm) and Table 10C (100 gsm). As shown in Table 10D and FIG. 23, webs made according to Mikami et al. Comparative Example 5 using a polymer like the 40 melt flow rate polymer employed by Mikami et al. had relatively low Deformation Resistance DR values. Employing a higher melt flow rate polymer than the Mikami et al. polymer or using a die with a greater number of smaller orifices per larger orifice than the Mikami et al. dies provided webs having significantly greater Deformation Resistance DR values.

EXAMPLE 11

Using an apparatus like that shown in FIG. 6 and procedures like those described in Wente, Van A. "superfine Thermoplastic Fiber", Industrial and Engineering Chemistry, vol. 48. No. 8, 1956, pp 1342-1346 and Naval Research Laboratory Report 111437, Apr. 15, 1954, a monocomponent monolayer web was formed using meltblowing of larger fibers and separately prepared smaller size fibers of the same polymeric composition. The larger size fibers were formed using TOTAL 3960 polypropylene (a 350 melt flow rate polymer) to which had been added 0.8% CHIMASSORB 944 hindered amine light stabilizer as an electret charging additive and 1% POLYONE™ No. CC 10054018WE blue pigment from PolyOne Corp. to aid in assessing the distribution of larger size fibers in the web. The resulting blue polymer blend was fed to a Model 20 DAVIS STANDARD™ 2 in. (50.8 mm) single screw extruder from the Davis Standard Division of Crompton & Knowles Corp. The extruder had a 60 in. (152 cm) length and a 30/1 length/diameter ratio. The smaller size fibers were formed using EXXON PP3746 polypropylene (a 1475 melt flow rate polymer) available from Exxon Mobil Corporation to which had been added 0.8% CHIMASSORB 944 hindered amine light stabilizer. This latter polymer was white in color and was fed to a KILLION™ 0.75 in. (19 mm) single screw extruder from the Davis Standard Division of Crompton & Knowles Corp. Using 10 cc/rev ZENITH™ melt pumps from Zenith Pumps, the flow of each polymer was metered to separate die cavities in a 20 in. (50.8 cm) wide drilled orifice meltblowing die employing 0.015 in. (0.38 mm) diameter orifices at a spacing of 25 holes/in. (10 holes/cm) with alternating orifices being fed by each die cavity. Heated air attenuated the fibers at the die tip. The airknife employed a 0.010 in. (0.25 mm) positive set back and a 0.030 in. (0.76 mm) air gap. A moderate vacuum was pulled through a medium mesh collector screen at the point of web formation. The polymer output rate from the extruders was 1.0 lbs/in/hr (0.18 kg/cm/hr), the DCD (die-to-collector distance) was 22.5 in. (57.2 cm) and the collector speed was adjusted as needed to provide webs with a 208 gsm basis weight. A 20 μm target EFD was achieved by changing the extrusion flow rates, extrusion temperatures and pressure of the heated air as needed. By adjusting the polymer rate from each extruder a web with 75% larger size fibers and 25% smaller size fibers was produced. The web was hydrocharged with distilled water according to the technique taught in U.S. Pat. No. 5,496,507 (Angadjivand et al. '507) and allowed to dry. Set out below in Table 11A are the Run Number, basis weight, EFD, web thickness, initial pressure drop, initial NaCl penetration and Quality Factor QF for the flat web at a 13.8 cm/sec face velocity:

TABLE 11A

| Run No. | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|
| 11-1F | 208 | 20.3 | 4.49 | 2.9 | 4.1 | 1.10 |

The Table 11A web was next molded to form a cup-shaped molded matrix for use as a personal respirator. The top mold was heated to about 235° F. (113° C.), the bottom mold was heated to about 240° F. (116° C.), a mold gap of 0.020 in. (0.51 mm) was employed and the web was left in the mold for about 6 seconds. Upon removal from the mold, the matrix retained its molded shape. Set out below in Table 11B are the Run Number, King Stiffness, initial pressure drop, initial NaCl penetration and maximum loading penetration for the molded matrix.

TABLE 11B

| Run No. | King Stiffness, N | Pressure Drop, mm $H_2O$ | Initial Penetration, % | Maximum Loading Penetration, % |
|---|---|---|---|---|
| 11-1M | 1.33 | 5.2 | 6.5 | 17.1 |

The data in Table 11B shows that the molded matrix had appreciable stiffness

EXAMPLE 12

Example 11 was repeated without using the electret charging additive in either the larger size or smaller size fibers. The web was plasma charged according to the technique taught in U.S. Pat. No. 6,660,210 (Jones et al.) and then hydrocharged with distilled water according to the technique taught in U.S. Pat. No. 5,496,507 (Angadjivand et al. '507) and allowed to dry. Set out below in Table 12A are the Run Number, basis weight, EFD, web thickness, initial pressure drop, initial NaCl penetration and Quality Factor QF for the flat web at a 13.8 cm/sec face velocity:

TABLE 12A

| Run No. | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|
| 12-1F | 204 | 13.4 | 4.92 | 5.2 | 1.9 | 0.76 |

The Table 12A web was next molded according to the method of Example 11. Upon removal from the mold, the matrix retained its molded shape. Set out below in Table 12B are the Run Number, King Stiffness, initial pressure drop, initial NaCl penetration and maximum loading penetration for the molded matrix.

TABLE 12B

| Run No. | King Stiffness, N | Pressure Drop, mm $H_2O$ | Initial Penetration, % | Maximum Loading Penetration, % |
|---|---|---|---|---|
| 12-1M | 1.47 | 8.6 | 1.95 | 3.67 |

The data in Table 12B shows that this molded matrix provides a monocomponent, monolayer filtration layer which passes the N95 NaCl loading test of 42 C.F.R. Part 84.

EXAMPLE 13

Using the method of Example 11, a monocomponent monolayer web was formed. The larger size fibers were formed using TOTAL 3868 polypropylene (a 37 melt flow rate polymer) to which had been added 0.8% CHIMASSORB 944 hindered amine light stabilizer from Ciba Specialty Chemicals as an electret charging additive and 2% POLYONE™ No. CC10054018WE blue pigment. The smaller size fibers were formed using EXXON PP3746G polypropylene to which had been added 0.8% CHIMASSORB 944 hindered amine light stabilizer. The polymer output rate from the extruders was 1.5 lbs/in/hr (0.27 kg/cm/hr), the DCD (die-to-collector distance) was 13.5 in. (34.3 cm) and the polymer rate from each extruder was adjusted to provide a web with 65% larger size fibers and 35% smaller size fibers. The web was hydrocharged with distilled water according to the technique taught in U.S. Pat. No. 5,496,507 (Angadjivand et al. '507) and allowed to dry. Set out below in Table 13A are the Run Number, basis weight, EFD, web thickness, initial pressure drop, initial NaCl penetration and Quality Factor QF for the flat web at a 13.8 cm/sec face velocity:

TABLE 13A

| Run No. | Basis Wt., gsm | EFD, μm | Thickness, mm | Pressure Drop, mm $H_2O$ | Initial Penetration, % | Quality Factor, 1/mm $H_2O$ |
|---|---|---|---|---|---|---|
| 13-1F | 226 | 15.1 | 3.76 | 3.8 | 1.3 | 1.06 |

The Table 13A web was next molded to form a cup-shaped molded matrix for use as a personal respirator. The top and bottom of the mold were both heated to about 230° F. (110° C.), a mold gap of 0.040 in. (1.02 mm) was employed and the web was left in the mold for about 9 seconds. Upon removal from the mold, the matrix retained its molded shape. Set out below in Table 13B are the Run Number, King Stiffness, initial pressure drop, initial NaCl penetration and maximum loading penetration for the molded matrix.

TABLE 13B

| Run No. | King Stiffness, N | Pressure Drop, mm $H_2O$ | Initial Penetration, % | Maximum Loading Penetration, % |
|---|---|---|---|---|
| 13-1M | 2.88 | 3.4 | 0.053 | 2.26 |

Figure 24:
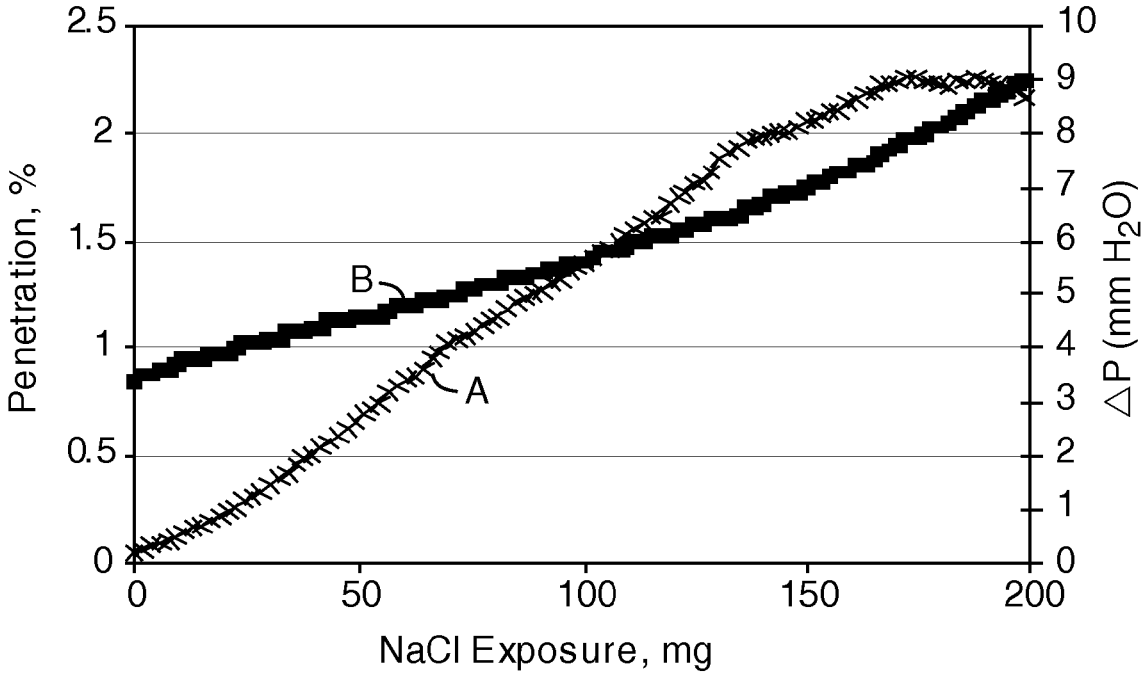
FIG. 24 is a graph showing % NaCl penetration and pressure drop for the molded respirator of Run No. 13-1M
Figure 25:
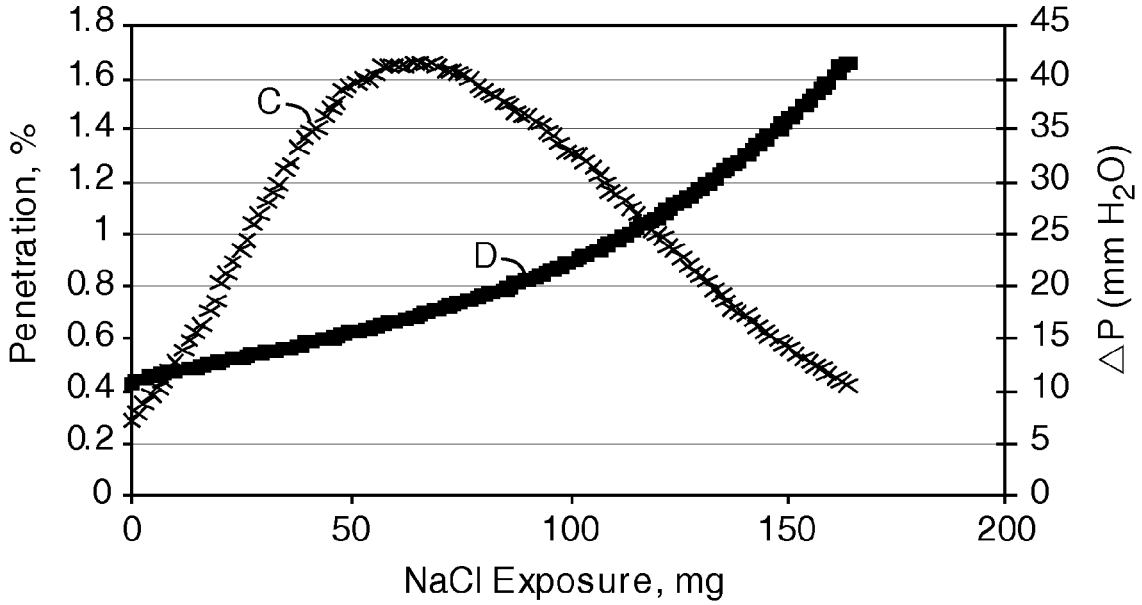
FIG. 25 is a similar graph for a commercial N95 respirator made from multilayer filtration media.

FIG. 24 is a graph showing % NaCl penetration and pressure drop for the molded respirator of Run No. 13-1M and FIG. 25 is a similar graph for a commercial N95 respirator made from multilayer filtration media. Curves A and B respectively are the % NaCl penetration and pressure drop results for the Run No. 13-1M respirator, and Curves C and D respectively are the % NaCl penetration and pressure drop results for the commercial respirator. FIG. 24 and the data in Table 13B show that the molded matrix of Run No. 13-1M provides a monocomponent, monolayer filtration layer which passes the N95 NaCl loading test of 42 C.F.R. Part 84, and which may offer longer filter life than the commercial respirator.

Figure 26:
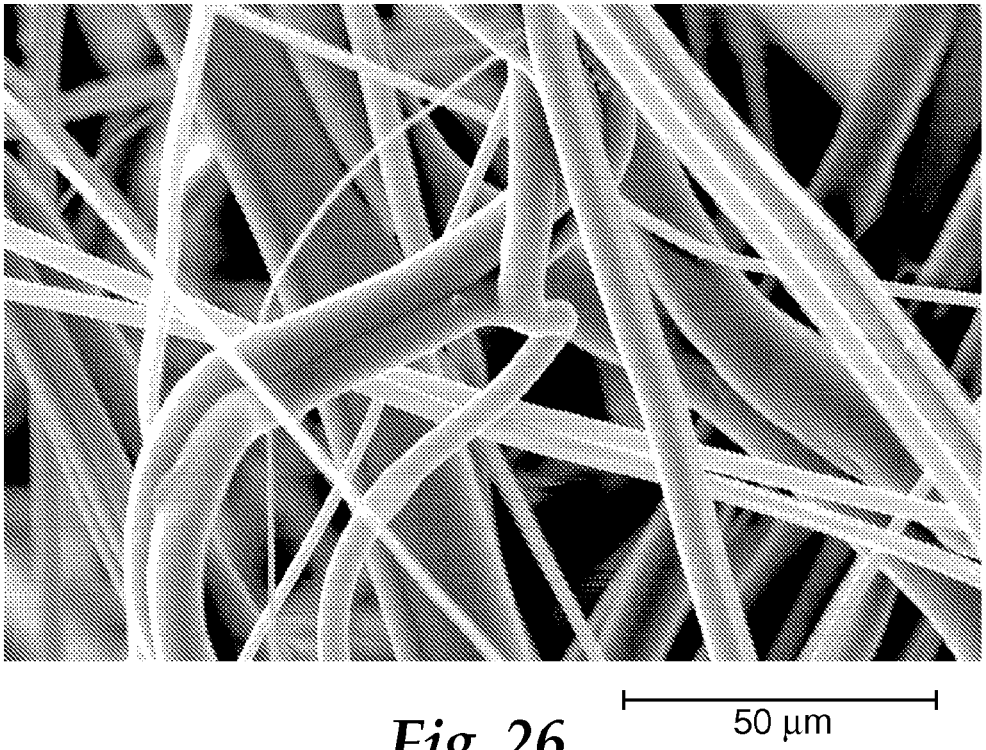
FIG. 26 and FIG. 27 respectively are a photomicrograph of and a histogram of fiber count (frequency) vs. fiber size in μm for the Run No. 13-1M molded matrix.
Figure 27:
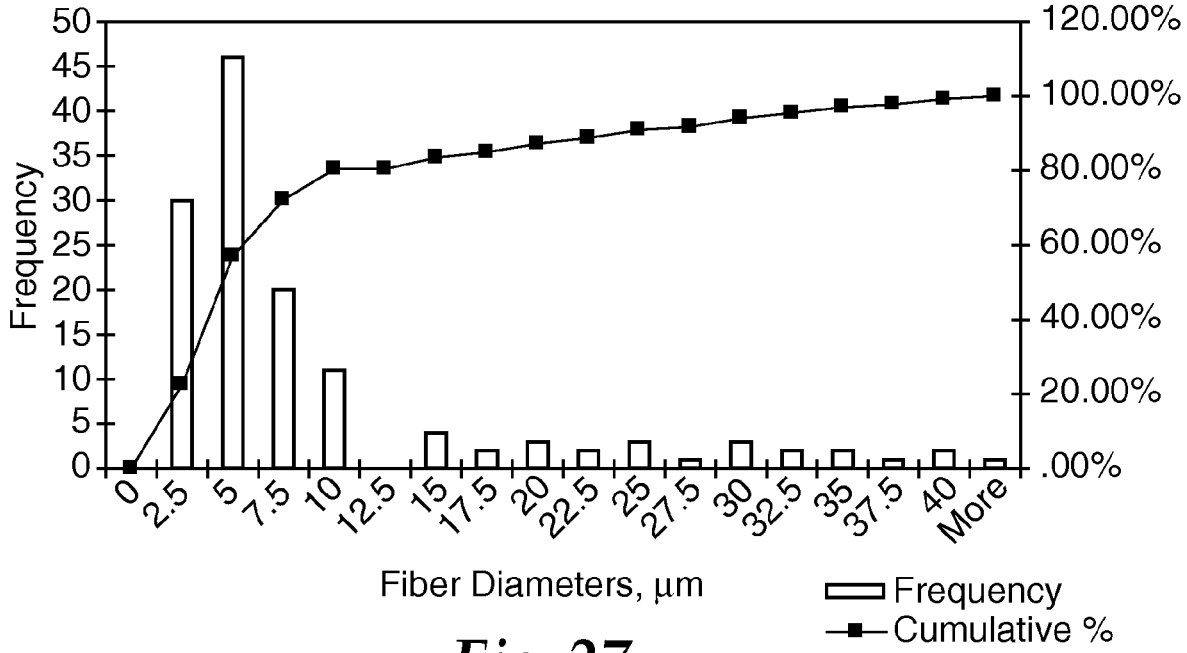

FIG. 26 and FIG. 27 respectively are a photomicrograph of and a histogram of fiber count (frequency) vs. fiber size in μm for the Run No. 13-1M molded matrix. Set out below in Table 13C is a summary of the fiber size distribution counts, and set out below in Table 13D is a summary of fiber size statistics for the Run No. 13-1M molded matrix.

TABLE 13C

| Size, μm | Frequency | Cumulative % |
|---|---|---|
| 0 | 0 | .00% |
| 2.5 | 30 | 22.56% |
| 5 | 46 | 57.14% |
| 7.5 | 20 | 72.18% |
| 10 | 11 | 80.45% |
| 12.5 | 0 | 80.45% |
| 15 | 4 | 83.46% |
| 17.5 | 2 | 84.96% |
| 20 | 3 | 87.22% |

TABLE 13C-continued

| Size, μm | Frequency | Cumulative % |
|---|---|---|
| 22.5 | 2 | 88.72% |
| 25 | 3 | 90.98% |
| 27.5 | 1 | 91.73% |
| 30 | 3 | 93.98% |
| 32.5 | 2 | 95.49% |
| 35 | 2 | 96.99% |
| 37.5 | 1 | 97.74% |
| 40 | 2 | 99.25% |
| More | 1 | 100.00% |

TABLE 13D

| Statistic | Value, μm |
|---|---|
| Average Fiber Diameter, μm | 8.27 |
| Standard Deviation Fiber Diameter, μm | 9.56 |
| Min Fiber Diameter, μm | 0.51 |
| Max Fiber Diameter, μm | 46.40 |
| Median Fiber Diameter, μm | 4.57 |
| Mode, μm | 2.17 |
| Fiber Count | 133 |

FIG. 26 shows that the matrix fibers are bonded to one another at at least some points of fiber intersection. FIG. 27 and the data in Table 13C show that the mixture of larger size fibers and smaller size fibers was polymodal, with at least three local modes.

EXAMPLE 14

Using the method of Example 2, webs were made from EXXON PP3746G polypropylene to which had been added 1% tristearyl melamine as an electret charging additive. For Run Nos. 14-1F and 14-2F a Zenith 10 cc/rev melt pump metered the flow of polymer to a 20 in. (50.8 cm) wide drilled orifice meltblowing die whose original 0.012 in. (0.3 mm) orifices had been modified by drilling out every 9th orifice to 0.025 in. (0.6 mm), thereby providing a 9:1 ratio of the number of smaller size to larger size holes and a 2:1 ratio of larger hole size to smaller hole size. The line of orifices had 25 holes/inch (10 holes/cm) hole spacing. Heated air attenuated the fibers at the die tip. The airknife employed a 0.010 in. (0.25 mm) positive set back and a 0.030 in. (0.76 mm) air gap. No to moderate vacuum was pulled through a medium mesh collector screen at the point of web formation. The polymer output rate from the extruder was varied from 2.0 to 3.0 lbs/in/hr (0.18 to 0.54 kg/cm/hr), the DCD (die-to-collector distance) was varied from 18.0 to 20.5 in. (45.7 to 52.1 cm) and the air pressure was adjusted as needed to provide webs with a basis weight and EFD as shown below in Table 14A. For Example 14-3F, a 20 in. (50.8 cm) wide drilled orifice meltblowing die with 0.015 in. (0.38 mm) orifices at 25 holes/inch (10 holes/cm) hole spacing was used. The polymer output rate from the extruder was 3.0 lbs/in/hr (0.54 kg/cm/hr), the DCD (die-to-collector distance) was 31 in. (78.7 cm) and the air pressure was adjusted as needed to provide webs with a basis weight and EFD as shown below in Table 14A.

TABLE 14A

| Run No. | Polymer Rate kg/cm/hr | Basis Wt., gsm | EFD, μm | Thickness, mm | Pressure Drop, mm $H_2O$ | Collector Distance cm |
|---|---|---|---|---|---|---|
| 14-1F | 0.18 | 151 | 11.7 | 2.59 | 5.2 | 45 |
| 14-2F | 0.54 | 151 | 11.7 | 2.69 | 5.1 | 52 |
| 14-3F | 0.54 | 150 | 11.5 | 2.87 | 5.1 | 78 |

A number of embodiments of the invention have been described. Nevertheless, it will be understood that various modifications may be made without departing from the invention. Accordingly, other embodiments are within the scope of the following claims.

We claim:

1. A molded respirator comprising a cup-shaped porous monocomponent monolayer matrix containing a charged bimodal mass fraction/fiber size mixture of continuous monocomponent meltblown attenuated polymeric microfibers and continuous monocomponent meltblown or meltspun attenuated polymeric larger size fibers, the microfibers and larger size fibers being intermingled with each other and being of the same polymeric composition, wherein the microfibers have a size of about 0.1 to about 5 μm and the larger size fibers have a size of about 15 to about 50 μm, the fibers being bonded to one another at at least some points of fiber intersection and the matrix having a King Stiffness greater than 1 N.

2. A molded respirator according to claim 1 wherein the histogram of mass fraction vs. fiber size in μm exhibits a larger size fiber mode of about 10 to about 50 μm.

3. A molded respirator according to claim 1 wherein the histogram of mass fraction vs. fiber size in μm exhibits a larger size fiber mode of about 10 to about 40 μm.

4. A molded respirator according to claim 1 wherein the histogram of mass fraction vs. fiber size in μm exhibits a microfiber mode of about 1 to about 5 μm and a larger size fiber mode of about 12 to about 30 μm.

5. A molded respirator according to claim 1 wherein a histogram of fiber count (frequency) vs. fiber size in μm exhibits at least two modes whose corresponding fiber sizes differ by at least 50% of the smaller fiber size.

6. A molded respirator according to claim 1 wherein the microfibers provide at least 20% of the fibrous surface area of the web.

7. A molded respirator according to claim 1 wherein the microfibers provide at least 40% of the fibrous surface area of the web.

8. A molded respirator according to claim 1 wherein the porous monocomponent monolayer matrix has a basis weight of about 80 to about 250 gsm.

9. A molded respirator according to claim 1 wherein the matrix has a King Stiffness of at least 2 N.

10. A molded respirator according to claim 1 which exhibits less than 5% maximum penetration when exposed to a 0.075 μm sodium chloride aerosol flowing at 85 liters/min.

11. A molded respirator according to claim 1 which exhibits less than 1% maximum penetration when exposed to a 0.075 μm sodium chloride aerosol flowing at 85 liters/min.

12. A molded respirator according to claim 1 wherein the polymeric microfibers and larger size fibers are comprised of polypropylene.

* * * * *

UNITED STATES PATENT AND TRADEMARK OFFICE

CERTIFICATE OF CORRECTION

PATENT NO. : 7,858,163 B2
APPLICATION NO. : 11/461145
DATED : December 28, 2010
INVENTOR(S) : Seyed Abol Hassan Angadjivand It is certified that error appears in the above-identified patent and that said Letters Patent is hereby corrected as shown below:

Column 7
Line 59, after "1 1/457,906," insert -- (Attorney Docket No. 60928US002), --.

Column 10
Line 6, after "11/457,899," insert -- (Attorney Docket No. 60632US002), --.

Column 15
Line 9, after "11/461,136," insert -- (Attorney Docket No. 61726US003), --.

Column 25-26
Line 9-10 (Table 6A), delete "Corona Hydrocharged" and insert -- Corona/Hydrocharged --, therefor.

Column 29
Line 24 (Approx.), delete "(11.8 A" and insert -- (11.8 orifices/cm). A --, therefor.

Column 32
Line 14, delete "CC 10054018WE" and insert -- CC10054018WE --, therefor.

Signed and Sealed this
Nineteenth Day of April, 2011

David J. Kappos

David J. Kappos
*Director of the United States Patent and Trademark Office*